US009472331B2

(12) United States Patent
Lefevre

(10) Patent No.: US 9,472,331 B2
(45) Date of Patent: Oct. 18, 2016

(54) PORTABLE MAGNETIZER SHEET FEEDER SYSTEM

(71) Applicant: Magnum Magnetics Corporation, Marietta, OH (US)

(72) Inventor: Richard D. Lefevre, Oconomowoc, WI (US)

(73) Assignee: MAGNUM MAGNETICS CORPORATION, Marietta, OH (US)

( * ) Notice: Subject to any disclaimer, the term of this patent is extended or adjusted under 35 U.S.C. 154(b) by 0 days.

(21) Appl. No.: 14/475,993

(22) Filed: Sep. 3, 2014

(65) Prior Publication Data

US 2015/0061800 A1 Mar. 5, 2015

Related U.S. Application Data

(60) Provisional application No. 61/873,564, filed on Sep. 4, 2013.

(51) Int. Cl.
*H01F 13/00* (2006.01)
*H01F 7/02* (2006.01)

(52) U.S. Cl.
CPC ..... *H01F 13/003* (2013.01); *H01F 7/0215* (2013.01)

(58) Field of Classification Search
CPC ..... H01F 13/003; H01F 7/0215
USPC ..... 335/284
See application file for complete search history.

(56) References Cited

U.S. PATENT DOCUMENTS

2012/0111773 A1* 5/2012 Ball, Sr. ..... H01F 13/003 209/213
2012/0188036 A1* 7/2012 Koren ..... H01F 13/003 335/284

* cited by examiner

*Primary Examiner* — Bernard Rojas
(74) *Attorney, Agent, or Firm* — Vorys, Sater, Seymour and Pease LLP; William L. Klima

(57) ABSTRACT

A sheet-feeder system for multiple feeding of magnetizable sheets from a stack through a portable magnetizer designed for on-site use, enclosed in a portable case which is hand-carryable. A sheet advancer advances single magnetizable sheets from the stack in a stack positioner. The sheet advancer includes a single-sheet separator configured to separate single magnetizable sheets from the stack during advancement. Magnetic attraction between a magnetizable sheet and a magnetic field generated by a sheet magnetizer configured to permanently magnetize single magnetizable sheets as they are advanced by the sheet advancer assists the sheet advancer to advance the single magnetizable sheets from the stack through the sheet magnetizer.

16 Claims, 23 Drawing Sheets

PORTABLE MAGNETIZER SHEET FEEDER SYSTEM

CROSS-REFERENCE TO RELATED APPLICATIONS AND CLAIM OF PRIORITY

This application claims priority under 35 U.S.C. §119(e) from U.S. Provisional Application Ser. No. 61/873,564 filed Sep. 4, 2013. This application is related to U.S. Pat. No. 8,754,733 issued Jun. 17, 2014 to the same assignee herein.

BACKGROUND OF THE INVENTION

This invention relates to improved magnetizer sheet feeder systems. More particularly, this invention provides a portable magnetizer system that improves the ability to rapidly single-feed and stack-feed a plurality of magnetizable sheets (i.e., sheets intended to be magnetized).

U.S. Pat. No. 8,754,733 discloses a portable magnetizer enclosed in a hand carried case, which can magnetize a planar sheet of magnetizable material. Rapid sheet feeding of magnetizable sheets through a portable magnetizer has heretofore not been accomplished. It would be useful in many instances to have such a capability. Magnetizing of sheeting is either conducted during manufacture, in large production lines, or by the above-described single-feed magnetizer. When only a small batch of sheets needs magnetizing, it is inefficient to utilize large scale methods of magnetization. A high-volume production magnetizer is expensive and may take up too much space for the benefit of smaller scale, occasional use on-site. Likewise, taking a batch of sheets to a high-volume production company for magnetization slows down production and consequently the high-volume production company charges increased fees.

A system is therefore needed to magnetize on-site, for less cost, in a portable and space saving manner.

SUMMARY OF THE INVENTION

The present invention to provides a system for rapid sheet feeding of magnetizable sheets to be magnetized through a portable magnetizer. The system of the present invention further provides adjustable sheet sizing of magnetizable sheets to be magnetized through a portable magnetizer. The inventive system further provides adjustable quantity sheet stacking of magnetizable sheets to be magnetized through a portable magnetizer.

More particularly, one aspect of the present invention provides a sheet-feeder system that feeds magnetizable sheets from a stack. A sheet advancer is configured to advance the magnetizable sheets from the stack, and a sheet magnetizer is configured to permanently magnetize the magnetizable sheets as they are advanced by the sheet advancer; wherein the sheet magnetizer is configured to generate a magnetic field capable of inducing permanent magnetization of the magnetizable sheets during the sheet advancement. The sheet advancer includes a single-sheet separator configured to separate single magnetizable sheets from the stack during sheet advancement. The sheet advancer is configured to advance the magnetizable sheets from the stack utilizing magnetic attraction between the magnetizable sheets and the magnetic field.

Additionally, the invention provides a magnetization sheet-feeder system wherein a sheet advancer includes a stack positioner configured to position the stack of magnetizable sheets in a position locating of the magnetizable sheets of the stack in interactive proximity with the magnetic field. Also, it provides such a sheet-feeder system wherein a stack positioner includes a lower support plate to support the stack; a first sidewall configured to limit stack movement in a first direction having an orientation substantially normal to a plane defined by a first side portion of the stack; and a second sidewall, opposite and substantially parallel to the first sidewall, configured to limit stack movement in a second direction having an orientation substantially normal to a plane defined by a second side portion of the stack. In addition, it provides such a sheet-feeder system wherein of such first sidewall and such second sidewall is moveably positionable such that a distance of separation between such first sidewall and such second sidewall is adjustable.

Additionally, the invention provides a sheet-feeder system having an enclosure configured to enclose the sheet advancer and the sheet magnetizer, and hand grip configured to permit hand-carrying of the enclosure. Also, the sheet magnetizer includes permanent magnet.

In accordance with one aspect of the invention, a sheet-feeder system is provided for feeding of single magnetizable sheets from a stack of such sheets, to a sheet magnetizer for magnetizing said single magnetizable sheets, the system including a stack positioner configured to hold the stack; a sheet advancer configured to advance single magnetizable sheets from the stack in the stack positioner, the sheet advancer including a single-sheet separator configured to separate single magnetizable sheets from the stack during such sheet advancement; and a sheet magnetizer configured to permanently magnetize single magnetizable sheets as they are advanced by the sheet advancer, where the sheet magnetizer is configured to generate a magnetic field capable of inducing permanent magnetization of the magnetizable sheets during such sheet advancement, wherein magnetic attraction between the single magnetizable sheets and the magnetic field generated by the sheet magnetizer assists the sheet advancer to advance the single magnetizable sheets from the stack through the sheet magnetizer.

In accordance with another aspect of the invention, a method is provided for feeding single magnetizable sheets from a stack of such sheets to a sheet magnetizer for magnetizing the single magnetizable sheets, comprising: advancing single magnetizable sheets from the stack in a stack positioner, the sheet advancer including a single-sheet separator configured to separate single magnetizable sheets from the stack during such sheet advancement; and permanently magnetizing single magnetizable sheets as they are advanced by the sheet advancer, the sheet magnetizer being configured to generate a magnetic field capable of inducing permanent magnetization of the magnetizable sheets during such sheet advancement, wherein magnetic attraction between the single magnetizable sheets and the magnetic field generated by the sheet magnetizer assists the sheet advancer to advance the single magnetizable sheets from the stack through the sheet magnetizer.

DETAILED DESCRIPTION OF THE INVENTION

The popularity of flexible magnetic sheet promotional products has steadily increased. Such flexible magnetic sheets have a printable surface that allows graphics and text to be printed on the flexible sheet by standard printers. These sheets can cause problems with printers when they are run through the printer after the sheet has been magnetized, since a magnetic field may interfere with the electronics of the printer. One solution to this problem is to print the printable side of the flexible sheets prior to magnetization. The sheets would then not interfere with printer function, and after printing, the sheets may then be run through a magnetizer.

Figure 1:
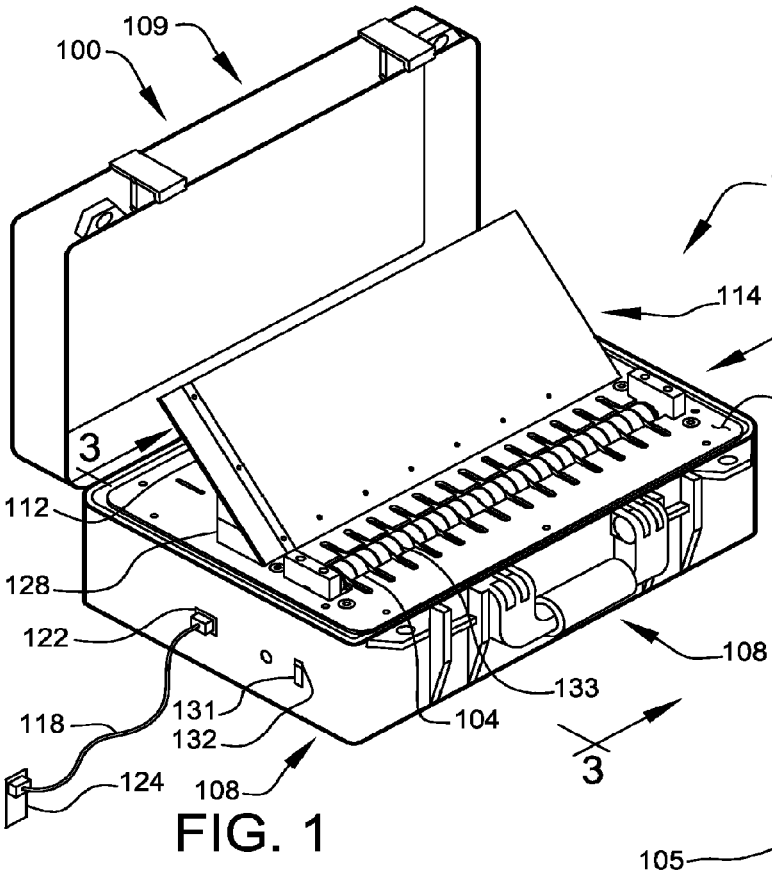
FIG. 1 is a perspective view, illustrating a portable magnetizer system in accordance with one embodiment of the present invention.

FIG. 1 shows a perspective view, illustrating a portable magnetizer system 100 in operable configuration 109. Portable magnetizer system 100 provides a solution to the problem of portable onsite magnetizing. Portable magnetizer system 100 comprises a portable magnetizer 105. Portable magnetizer 105 comprises a briefcase enclosure 108. Under appropriate circumstances, considering such issues as cost, future technologies, etc., other enclosures, such as, for example, box enclosures, top carry enclosures, soft case enclosures, etc., may suffice. Portable magnetizer 105 comprises a magnetizer assembly housed inside briefcase enclosure 108, as shown.

Magnetizer assembly 101 comprises magnetic roller 133 and feed tray 112 mounted to panel 106 (see FIG. 10 through FIG. 17). Magnetic roller 133 comprises magnetizer array 104. Under appropriate circumstances, considering such issues as cost, future technologies, etc., other magnetizing arrangements, such as, for example, rollers with separate magnetizer arrays, magnetic bars arrays, dual magnetic field sources, etc., may suffice.

In operable configuration 109, briefcase enclosure 108 is in an open position, as shown. Feed tray 112 is in angled position 114, as shown. A power cord 118 is plugged into power cord receptacle 122 within portable magnetizer 105 and wall outlet 124, as shown. Under appropriate circumstances, considering such issues as site location, cost, future technologies, etc., other power sources, such as, for example, solar power cells, batteries, vehicle electrical circuits, etc., may suffice.

Figure 2:
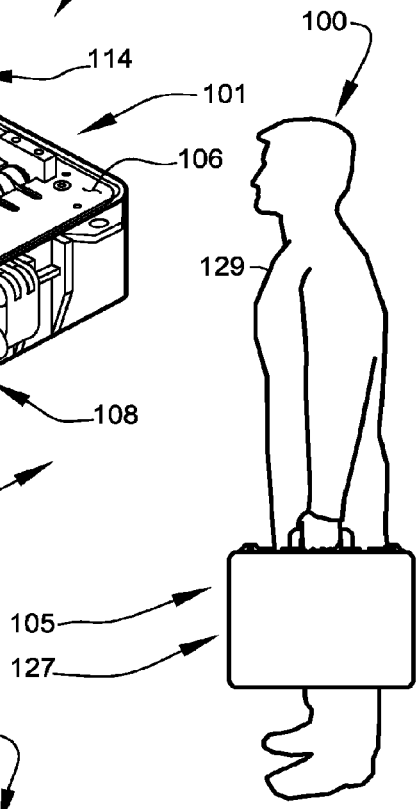
FIG. 2 is a side view, illustrating a portable magnetizer being carried by a user, according to the embodiment of FIG. 1.

FIG. 2 shows a side view illustrating portable magnetizer 105 being carried by user 129. Portable magnetizer 105 is closed and placed in stowed configuration 127 when not in use, as shown best in FIG. 4 and FIG. 5. stowed configuration 127 of portable magnetizer 105 assists user 129 to carry portable magnetizer 105, as shown. Portable magnetizer 105 weighs about 25 lbs.

With reference to FIG. 1, portable magnetizer 105 is deployed by user 129 to operable configuration 109 prior to use. First, briefcase enclosure 108 is opened, as shown in FIG. 1. Then, feed tray 112 is deployed to angled position 114 using tray mount 128, as further discussed in detail below with reference to FIGS. 14-17. After plugging in power cord 118, power switch 131 is then turned to "on" position 132. Turning power switch 131 to "on" position 132 activates rotation of magnetic roller 133. Portable magnetizer 105 utilizes standard electrical power (about 115 volts alternating current with about 1.6 amperes of current load).

Figure 3:
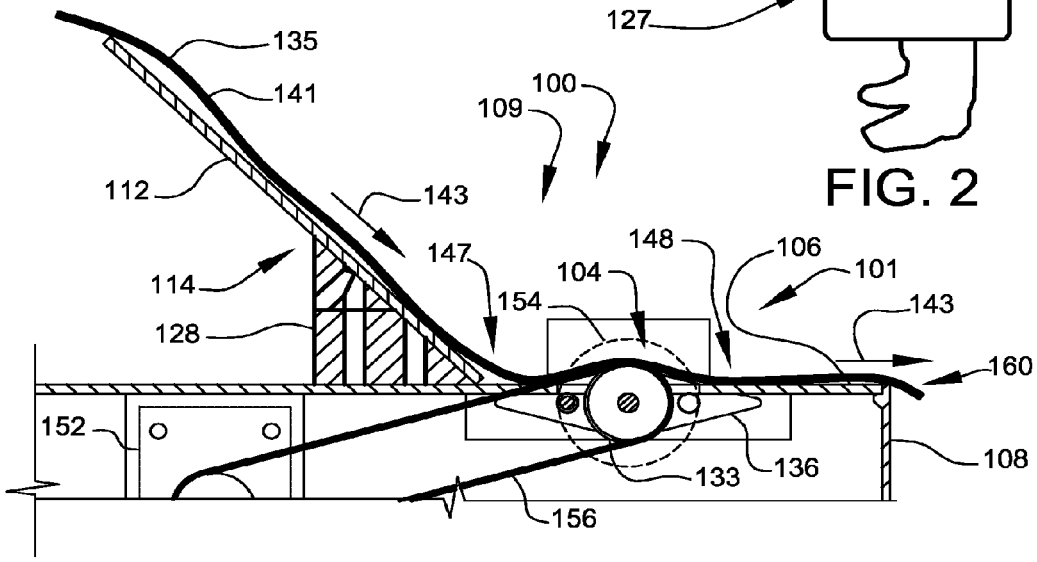
FIG. 3 is a partial cross-sectional view through section 3-3 of FIG. 1, illustrating a flexible magnetizable sheet in transit adjacent to a magnetic roller, according to the embodiment of FIG. 1.

FIG. 3 is a partial cross-sectional view through section 3-3 of FIG. 1, illustrating a flexible magnetizable sheet 141 in transit adjacent to magnetic roller 133, according to the embodiment of FIG. 1. Flexible magnetizable sheet 141 is loaded into feed tray 112. Flexible magnetizable sheet 141 is loaded with printed side 135 facing away from feed tray 112. Magnetic roller 133 pulls flexible magnetizable sheet 141 from feed tray 112 through rotation and magnetic coupling. The magnetizer bar of the roller 133 magnetically couples to the planar sheet to transfer movement to the planar sheet. Magnetic roller 133 then drives flexible magnetizable sheet 141 along feed path 143 through rotation and magnetic coupling, as shown. Magnetic roller 133 can run between about 10 feet/min and about 50 feet/min, and typically is run at about 15 feet/min.

Magnetizer array 104 comprises a length of about 13 inches, allowing portable magnetizer 105 to magnetize flexible magnetizable sheet 141 comprising less than about 13 inches in width Under appropriate circumstances, considering such issues as cost, future technology, etc., other magnetizer array lengths, such as, for example, 24 inches, 10 inches, 10 cm, etc., may suffice.

Magnetizer array 104 further comprises stripper plates 136. Stripper plates 136 in magnetizer array 104 guide flexible magnetizable sheet 141 over the magnetic roller 133. Stripper plates 136 are shaped to allow flexible magnetizable sheet 141 to be guided on entry side 147 and off exit side 148 of magnetic roller 133.

Magnetic roller 133 couples with and moves flexible magnetizable sheet 141 over magnetizer array 104 by rotation and magnetic coupling as previously stated. Motor 152 and chain drive 156 provide rotary movement of magnetic roller 133. In the process of passing over magnetizer array 104, flexible magnetizable sheet 141 is magnetized by the magnetic field 154 from magnetic roller 133. (Magnetic roller 133 components will be discussed in more detail in FIGS. 6 through FIG. 9.)

Flexible magnetizable sheet 141 is moved along feed path 143 to exit side 148 of magnetic roller 133, guided by stripper plates 136. Stripper plates 136 de-couple flexible magnetizable sheet 141 from magnetic roller 133 during operation. Flexible magnetizable sheet 141 moves from exit side 148 of magnetic roller 133 to panel 106. Flexible magnetizable sheet 141 then moves off edge 160 of briefcase enclosure 108. Under appropriate circumstances, considering such issues as design preference, user preferences, marketing preferences, cost, structural requirements, available materials, technological advances, etc., other magnetic field generator arrangements such as, for example, solenoids, Helmholtz coils, bar magnets, iron core solenoids, electromagnets, or other magnetic generator technologies, etc., may suffice.

Figure 4:
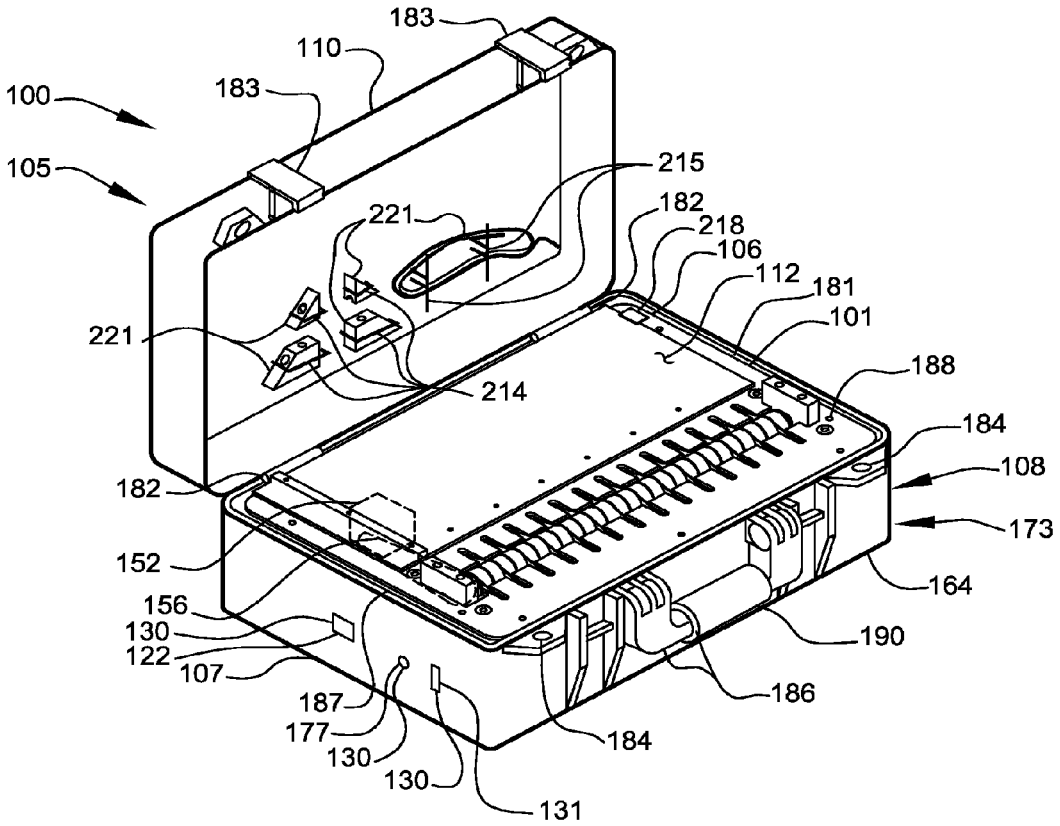
FIG. 4 shows a perspective view, illustrating a briefcase enclosure in an open position with loose items and a feed tray secured therein, according to the embodiment of FIG. 3.

FIG. 4 shows a perspective view illustrating briefcase enclosure 108 in open position 110 with loose items 221 and feed tray 112 secured therein. One example of briefcase enclosure 108 is Pelican Model 1500 case 10, available from Pelican Products, Inc., Torrance, Calif. Briefcase enclosure 108 comprises seal 181, hinge 182, latch 183, padlock hole 184 and handle 186. Seal 181 comprises an O-ring seal, following along the perimeter of briefcase enclosure 108, as shown. Latch 183 comprises a double throw latch, as shown. Padlock hole 184 comprises a reinforced padlock hole, such as a stainless steel reinforced padlock hole, as shown. Handle 186 comprises a molded handle and rubber padding 190. Briefcase enclosure 108 further comprises a continuous panel flange 187 with pre-drilled holes 188 to receive and mount panel 106. Panel 106, which mounts to panel flange 187, comprises magnetizer array 104, feed tray 112, and motor 152. Briefcase enclosure 108 also comprises accessory openings 130, including an aperture providing access to an interior of the briefcase even when the briefcase is closed; and an aperture structured and arranged to permit operating power connection between the motor and the external power source, and to receive power switch 131, power cord receptacle 122 and fuse 177.

Briefcase enclosure 108 serves several functions for portable magnetizer 105. Briefcase enclosure 108 houses magnetizer assembly 101, keeping motor 152 and chain drive 156 contained (as well as guarded for safety during operation), as shown (see also FIG. 3). Panel 106 and lower portion 173 of briefcase enclosure 108 make up housing 164, which provides an operation-isolated-region structured and arranged to assist protection of the magnetizer and the rotary movement generator or motor from external interaction, during operation of the magnetizer. Motor 152 and chain drive 156 are contained while in operable configuration 109 (see FIG. 1) or in stowed configuration 127 (see FIG. 5).

Another function of the briefcase enclosure 108 is to secure loose items 221. Loose items 221 are items within portable magnetizer system 100, which when not secured, could damage magnetizer assembly 101 during movement or relocation of portable magnetizer 105. Loose items 221 include tray mounts 128 and power cord 118. Loose items 221 are secured by user 129 configuring briefcase enclosure 108 to stowed configuration 127 (see FIG. 5). In stowed configuration 127, tray mounts 128, power cord 118, and feed tray 112 are secured. Feed tray 112 collapses to the position shown in FIG. 4 when being stored or transported. Briefcase enclosure 108 comprises storage mount 214 for tray mounts 128 and storage mount 215 for power cord 118. Additionally, feed tray 112 is secured with lock down mechanism 218 to prevent movement of feed tray 112 while in stowed configuration 127. Securing loose items 221 prevents damage to magnetizer assembly 101. Under appropriate circumstances, considering such issues as cost, future technology, etc., other loose item securing devices, such as, for example, cord retractors, collapsible tray mounts, spring locks, molded forms, molded foams, etc., may suffice.

Figure 5:
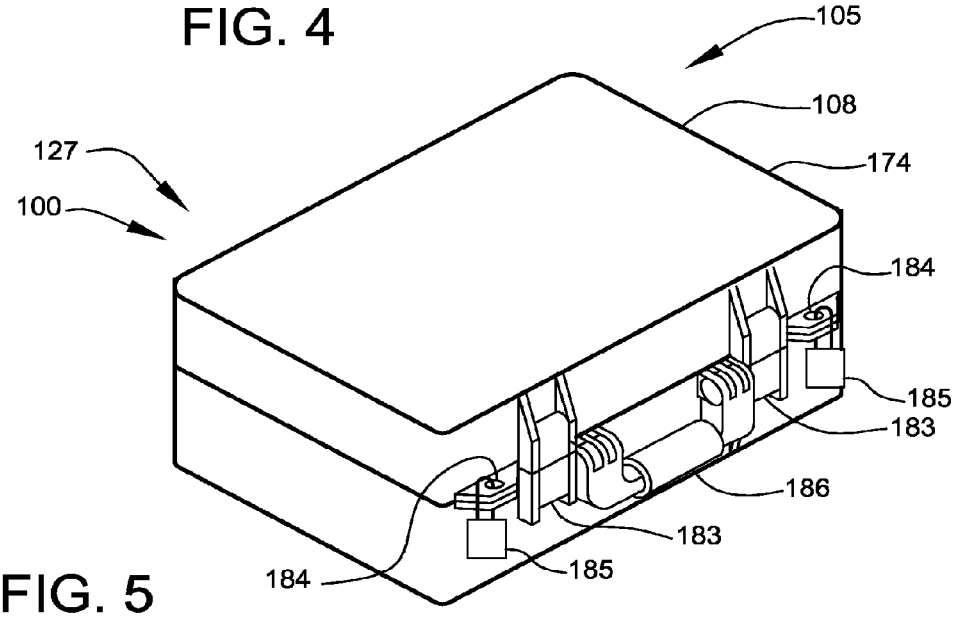
FIG. 5 shows a perspective view illustrating such briefcase enclosure in a stowed configuration, according to the embodiment of FIG. 4.

FIG. 5 is a perspective view illustrating briefcase enclosure 108 in stowed configuration 127. Another function of briefcase enclosure 108 is to make portable magnetizer 105 portable, secure, and easily storable. Portable magnetizer 105 becomes portable, secure, and easily storable when transitioned to stowed configuration 127, as shown. When the user is ready to transition briefcase enclosure 108 to stowed configuration 127, loose items 221 are secured as previously mentioned (see FIG. 4). Briefcase lid 174 is then closed and latched with latches 183. A padlock 185 is then inserted into padlock hole 184 and locked. User 129 carries briefcase enclosure 108 by grasping handle 186 as shown in FIG. 2.

Stowed configuration 127 reduces the size of the portable magnetizer 105, making it smaller for storage. Stowed configuration 127 also allows for simplified handling and moving of portable magnetizer 105 by configuring the portable magnetizer 105 into a manageable size that can be easily held by handle 186. In addition, padlock 185 adds security to portable magnetizer 105 by controlling access to briefcase enclosure 108. Under appropriate circumstances, considering such issues as design preference, user preferences, marketing preferences, cost, structural requirements, available materials, technological advances, etc., other enclosure arrangements such as, for example, custom case designs, OEM preconfigured briefcases, or cases made of alternate materials (such as steel, aluminum, wood, or wireframe), etc., may suffice.

Figure 6:
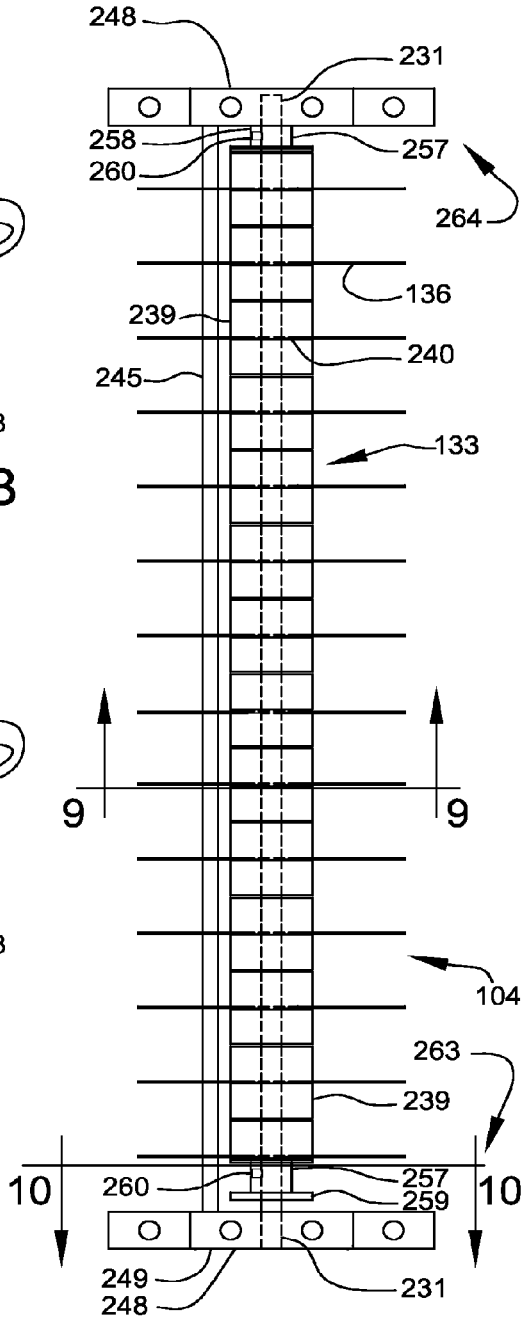
FIG. 6 shows a top view, illustrating magnetizer array with array mounts, according to the embodiment of FIG. 1.

FIG. 6 is a top view illustrating magnetizer array 104 with array mounts 248. Magnetizer assembly 101, as shown (see FIG. 1) comprises magnetizer array 104, as shown (see FIG. 6). Magnetizer array 104 comprises a magnetic roller 133 as previously mentioned. Magnetic roller 133 is about 1" in diameter. Magnetic roller 133 comprises a plurality of magnetic stacks 239, and shaft 231. Shaft 231 rotates magnetic stacks 239 of magnetic roller 133 during operation. Shaft 231 and thereby magnetic stacks 239 of magnetic roller 133 are rotated by motor 152 and chain drive 156. Rotation of magnetic roller 133 moves flexible magnetizable sheet 141 over magnetizer array 104 as previously stated. Magnetic field 154 of magnetic roller 133 induces a magnetic field and magnetic alignment in flexible magnetizable sheet 141 as it passes over the magnetic roller 133. Flexible magnetic sheet 141 retains a portion of this magnetic alignment and thereby becomes magnetized.

Stripper plates 136 are spaced about 1 inch apart along shaft 231 between magnetic stacks 239, comprising a set of discrete field-producing laminations spaced substantially along the longitudinal axis; and wherein a sheet decoupler comprises a plurality of decoupler elements spaced about every inch along the longitudinal axis, as shown. Magnetizer array 104 further comprises stabilizer bar 245, which runs between array mounts 248. Stabilizer bar 245 stabilizes stripper plates 136, and prevents rotation of stripper plates 136, during operation. Further, stabilizer bar 245 positions stripper plates 136 to optimize operation of magnetizer assembly 101.

Figure 7A:
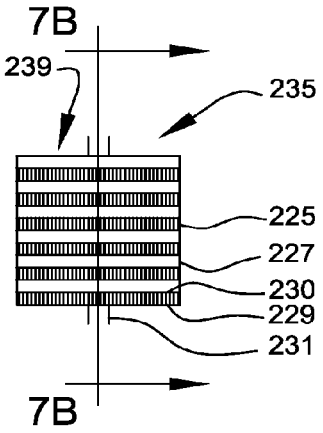
FIG. 7A shows an enlarged top view, illustrating a magnetic stack, according to another aspect of the present invention.

FIG. 7A is an enlarged top view illustrating a magnetic stack, according to an embodiment of the present invention, wherein magnetic stack 239 comprises permanent magnet disks 225 (disk magnets) alternately interspersed with steel washers 227 along shaft 231. Disk magnets 225 are arranged with all like poles facing the same direction so as to alternate positive poles 229 and negative poles 230, along magnetic stack 239. Under appropriate circumstances, considering such issues as cost, future technologies, etc., other magnet arrangements, such as, for example, segmented disk magnets, mono-pole magnets, intrinsically layered magnets, etc., may suffice. Magnetic stack 239 typically comprises a diameter of about 1 inch and a length of about 1 inch.

Figure 7B:
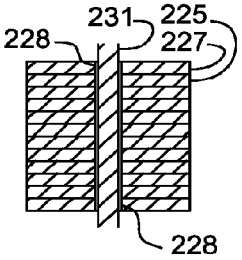
FIG. 7B shows a sectional view through the section 7B-7B of FIG. 7A, illustrating a 12-PPI stack set on a shaft.

According to one embodiment, magnetic stack 239 comprises a 12-PPI (poles per inch) stack 235 (herein sometimes referred to as PPI stack). 12-PPI stack 235 is set on shaft 231. 12-PPI stack 235 comprises 12 disk magnets 225 and 12 steel washers 227 per inch. 12-PPI stack 235 comprises a magnetic field of between about 5000 gauss and 6000 gauss. FIG. 7B is a sectional view through the section 7B-7B of FIG. 7A, illustrating 12-PPI stack 235 set on shaft 231. Disk magnets 225 and steel washers 227 have center hole 228 permitting placement over shaft 231.

Figure 8A:
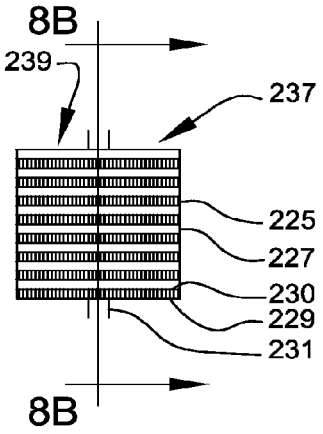
FIG. 8A shows an enlarged top view, illustrating an alternate magnetic stack configuration, according to another embodiment of the present invention.
Figure 8B:
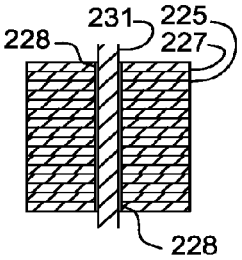
FIG. 8B shows a sectional view through the section 8B-8B of FIG. 8A, illustrating a 16-PPI stack set on a shaft.

FIG. 8A is an enlarged top view, illustrating an alternate embodiment of magnetic stack 239, according to another embodiment of the present invention. FIG. 8B is a sectional view through the section 8B-8B of FIG. 8A illustrating a 16-PPI stack 237 set on shaft 231. 16-PPI stack 237 comprises 16 disk magnets 225 and 16 steel washers 227 per inch. 16-PPI stack 237 comprises a magnetic field of between about 4000 gauss and about 5000 gauss.

Figure 9:
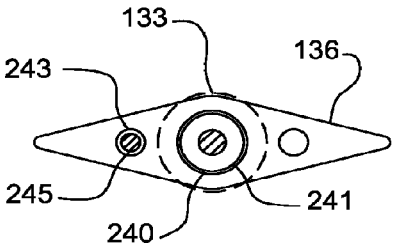
FIG. 9 shows a sectional view through the section 9-9 of FIG. 6, illustrating a stripper plate with a small-diameter washer, shaft, and a stabilizer bar.

FIG. 9 is a sectional view through section 9-9 of FIG. 6, illustrating a stripper plate 136 with small-diameter washer 241, shaft 231, and stabilizer bar 245. Stripper plate 136 comprises a center hole 240 to allow for small-diameter washer 241. Small-diameter washer 241 fits on shaft 231, inside the center hole 240 of the stripper plate 136. Small-diameter washer 241, made of steel, provides spacing clearance between rotating portions of magnetic roller 133 and stripper plate 136. Small-diameter washer 241 spaces the stripper plate from shaft 231, as well as isolating the stripper plate 136 from shaft rotation. In addition, small-diameter washer 241 is slightly thicker than stripper plate 136, to space stripper plate 136 away from magnetic stack 239 on either side. Stripper plates 136 do not rotate during operation of magnetizer assembly 101. Stabilizer bar 245 runs through stabilizer-bar hole 243 in stripper plates 136. Stabilizer bar 245 connects to array mount 248 at each end of magnetizer array 104 (see FIG. 6), at stabilizer-bar mounting hole 253 (see FIG. 10).

Stabilizer bar 245, along with small-diameter washer 241, prevents stripper plates 136 from rotating. Stripper plates 136 are held by stabilizer bar 245 to counter rotation of shaft 231, and magnetic roller 133, during operation of magnetizer assembly 101. Stripper plates 136 are stabilized by stabilizer bar 245 allowing stripper plates 136 to guide flexible magnetizable sheet 141 over the magnetic roller 133 as previously mentioned with respect to FIG. 3. Endplates 257 are mounted on both sides of shaft 231 to hold the magnetic stacks 239, stripper plates 136, and small-diameter washers 241 on shaft 231, as shown in FIG. 6. Endplates 257 comprise endplate locking-screw 260. Endplate locking-screw 260 secures endplates 257 to shaft 231. Endplates 257 apply pressure to transfer rotation of shaft 231 to magnetic stacks 239, and small-diameter washers 241. Under appropriate circumstances, considering such issues as cost, future technologies, etc., other rotation transfer devices, such as, for example, key shafts, locking screws, adhesives, etc., may suffice.

Gear-drive endplate 259 is located on shaft 231 at motor side 263 of magnetizer array 104. Gear-drive endplate 259 provides connection of shaft 231 to chain drive 156 and motor 152, as discussed in detail with reference to FIGS. 18-19. Opposed endplate 258 is located on shaft 231 at non-motor side 264 of magnetizer array 104. Under appropriate circumstances, considering such issues as design preference, user preferences, marketing preferences, cost, structural requirements, available materials, technological advances, etc., other magnetizer holding arrangements such as, for example, non circular shafts, cable shafts, or non-shaft magnetizer, etc., may suffice.

Figure 10:
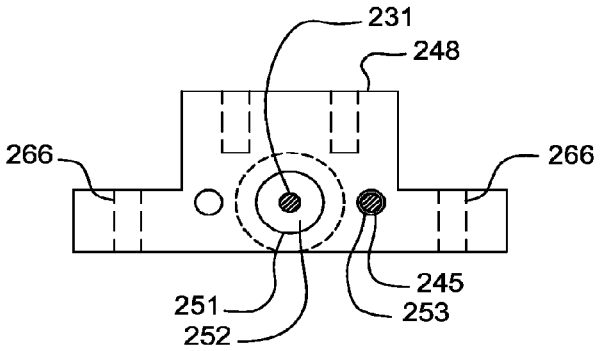
FIG. 10 shows a sectional view through the section 10-10 of FIG. 6, illustrating an array mount.

FIG. 10 is a sectional view through the section 10-10 of FIG. 6, illustrating array mount 248. Array mount 248 comprises a shaft-hole 251. A low-friction bearing 252 is set into shaft-hole 251 by tight friction fit. Shaft 231, with magnetizer array 104, is set into low-friction bearing 252. Under appropriate circumstances, considering such issues as cost, future technology, etc., other rotating shaft mountings, such as, for example, rotating end-plates, coaxial bearings, lubricated joints, etc., may suffice. Array mount 248 also comprise threaded holes 266. Threaded holes 266 receive array mount bolts 267 (as shown best in FIGS. 11-13) to secure array mount 248 to panel 106. Under appropriate circumstances, considering such issues as cost, future technology, materials, etc., other fasteners, such as, for example, rivets, pins, adhesives, etc., may suffice. Array mount 248 comprises stabilizer-bar mounting hole 253. Stabilizer-bar mounting hole 253 accepts an end of stabilizer bar 245. Array mount 248 is set on shaft 231 of magnetizer array 104. Low friction bearing 252 allows magnetic roller 133 to rotate freely between array mounts 248.

Figure 11:
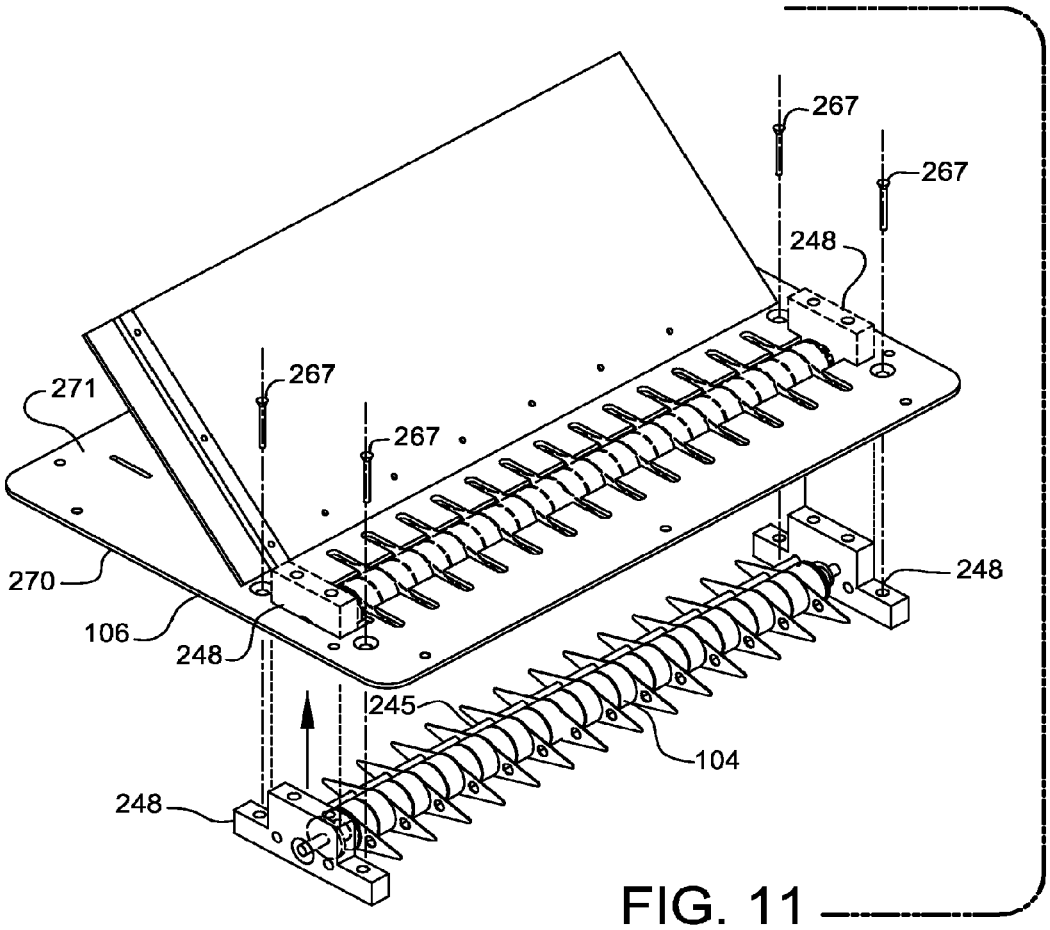
FIG. 11 shows an isometric exploded view, illustrating a magnetizer array assembly, according to the embodiment of FIG. 10.

FIG. 11 is an isometric exploded view, illustrating magnetizer array assembly 205 according to the embodiment of FIG. 10. Magnetizer array assembly 205 comprises magnetizer array 104 attaching to underside 270 of panel 106 with array mount 248. Array mounts 248, along with magnetizer array 104, are joined to underside 270 of panel 106. Array mounts 248 are bolted to panel 106 with array mount bolts 267.

Figure 12:
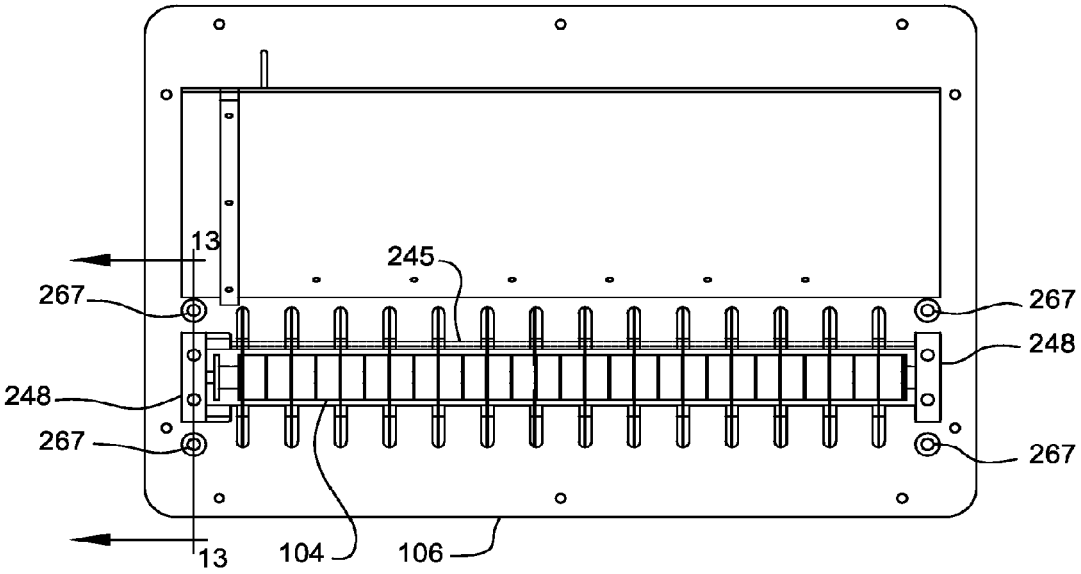
FIG. 12 shows a top view, illustrating the magnetizer array attached to such panel, according to the embodiment of FIG. 11.
Figure 13:
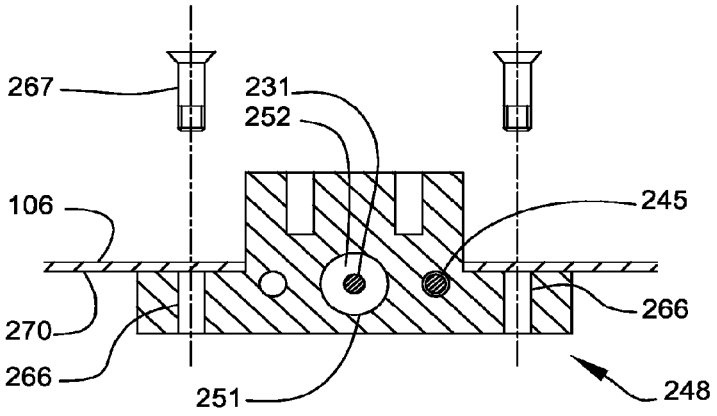
FIG. 13 shows a partial sectional view through the section 13-13 of FIG. 12, illustrating the array mount attachment to the panel, according to the embodiment of FIG. 12.

FIG. 12 is a top view, illustrating magnetizer array 104 attached to panel 106, according to the embodiment of FIG. 11. FIG. 13 shows a partial sectional view through the section 13-13 of FIG. 12, illustrating array mount 248 attachment to panel 106, according to the embodiment of FIG. 12. Array mounts 248 hold magnetizer array 104 to panel 106. Mounting magnetizer array 104 to panel 106 stabilizes gear-drive endplate 259. As previously stated, gear drive-endplate 259 is driven by chain drive 156 and motor 152 (see FIG. 19) to rotate the magnetic roller 133. Array mounts 248 also hold magnetizer array 104 in alignment with feed tray 112.

Figure 14:
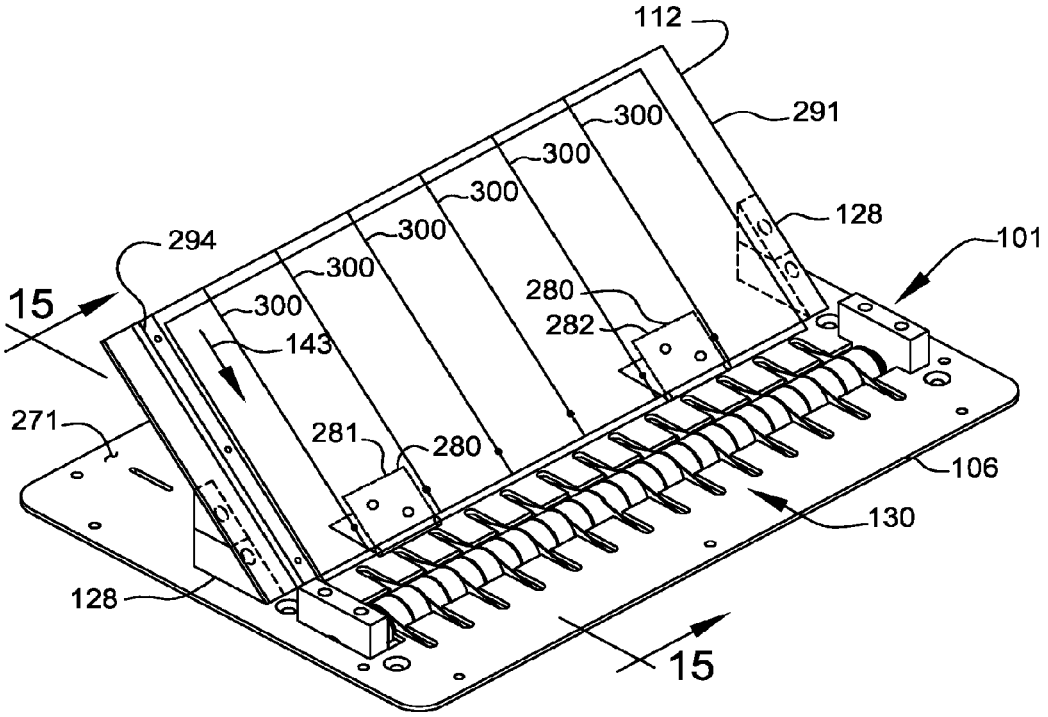
FIG. 14 shows an isometric view, illustrating the feed tray mounted to such panel, according to the embodiment of FIG. 13.

FIG. 14 is an isometric view, illustrating feed tray 112 mounted to panel 106, according to the embodiment of FIG. 13. Feed tray 112 comprises feed-tray panel 291, which comprises steel. Feed tray 112 further comprises adjustable guide 294, which also comprises steel. Adjustable guide 294 is attached to feed-tray panel 291 with counter-sink screws 295 (see FIG. 17). Adjustable guide 294 is mounted on feed tray 112 in one of variable positions 300 to assist feeding flexible magnetizable sheet 141 straight across magnetic roller 133. User 129 locates adjustable guide 294 as required at one of the variable positions 300 on feed tray 112. User 129 attaches adjustable guide 294 as required.

Figure 15:
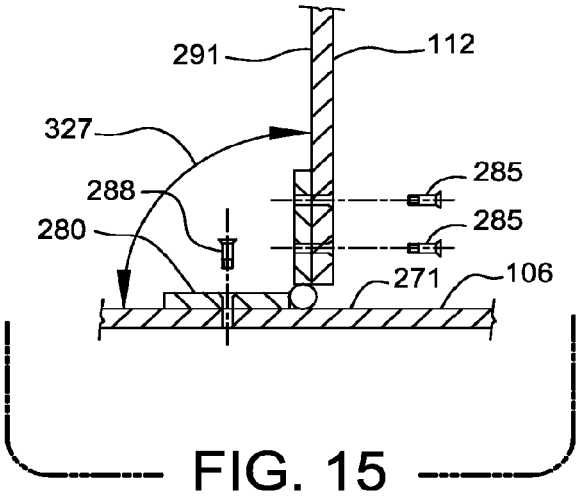
FIG. 15 shows an enlarged partial cross-section through the section 15-15 of FIG. 14, illustrating a hinge attaching feed tray to the panel.

FIG. 15 shows an enlarged partial cross-section through section 15-15 of FIG. 14, illustrating hinge attaching feed tray 112 to panel 106. Feed tray 112 is attached to panel 106 with feed-tray hinge 280. Feed-tray hinge 280 is fastened to feed tray 112 with counter-sink screws 285. Feed-tray hinge 280 is also fastened to top 271 of panel 106 with counter-sink screw 288.

Figure 16:
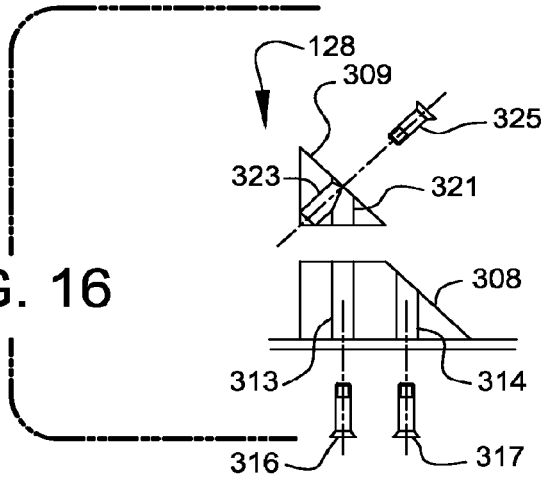
FIG. 16 shows a side exploded elevation view, illustrating a tray mount, according to the embodiment of FIG. 15.
Figure 17:
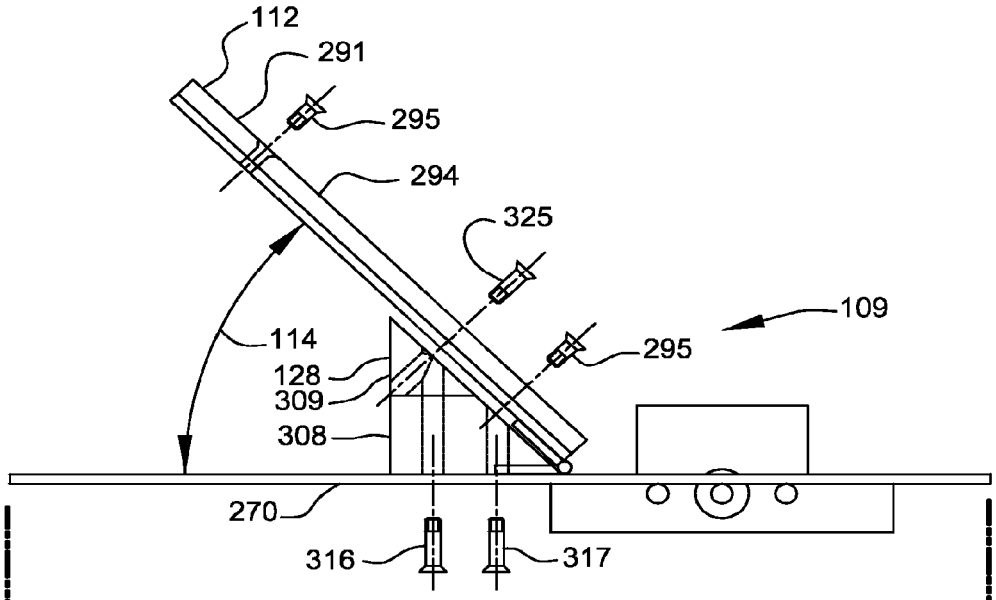
FIG. 17 shows a side view of the magnetizer, illustrating the feed tray and tray mounts deployed to an operable position, according to the embodiment of FIG. 16.

FIG. 16 shows a side exploded elevation view, illustrating tray mount 128, according to the embodiment of FIG. 15. Tray mount 128 is used to deploy feed tray 112 to angled position 114. Feed tray 112 comprises tray mount 128, two tray mounts 128. Tray mount 128 comprises tray mount base 308 and tray mount top 309. Tray mount base 308 comprises threaded-hole 313 and threaded-hole 314 to receive counter-sink screw 316 and counter-sink screw 317 respectively, to mount tray mount 128 to panel 106, as shown in FIG. 17. Tray mount top 309 comprises hole 321 and threaded hole 323. Threaded hole 323 receives counter-sink screw 325 to hold feed tray panel 291 to tray-mount top 309. When the user is ready to deploy feed tray 112 to angled position 114, feed tray 112 is positioned to up position 327, as shown in FIG. 15. Up position 327 allows mounting of tray mounts 128. Tray mounts 128 are mounted as previously described. Feed-tray panel 291 is then rotated back to angled position 114. Feed-tray panel 291 is then secured to tray mounts 128 with counter-sink screw 325 as previously mentioned.

FIG. 17 shows a side view of magnetizer assembly 101 illustrating feed tray 112 and tray mounts 128 deployed to operable configuration 109, according to the embodiment of FIG. 16. User 129 deploys feed tray 112 by attaching tray-mount base 308 to top 271 of panel 106. Counter-sink screw 316 and counter-sink screw 317 enter tray-mount base 308 from underside 270 of panel 106. Tray-mount top 309 is attached to tray-mount base 308. Feed-tray panel 291 is secured to tray-mount top 309 in angled position 114 by counter-sink screw 325. Feed-tray panel 291 is held by feed-tray hinges 280 and tray mounts 128. Feed-tray panel 291 is deployed to angled position 114, which puts feed tray 112 in operable configuration 109. Feed tray 112, secured to tray mounts 128, positions flexible magnetizable sheet 141 along feed path 143 towards magnetizer array 104. Flexible magnetizable sheet 141 is positioned against the adjustable guide 294 as it is fed in.

Figure 18:
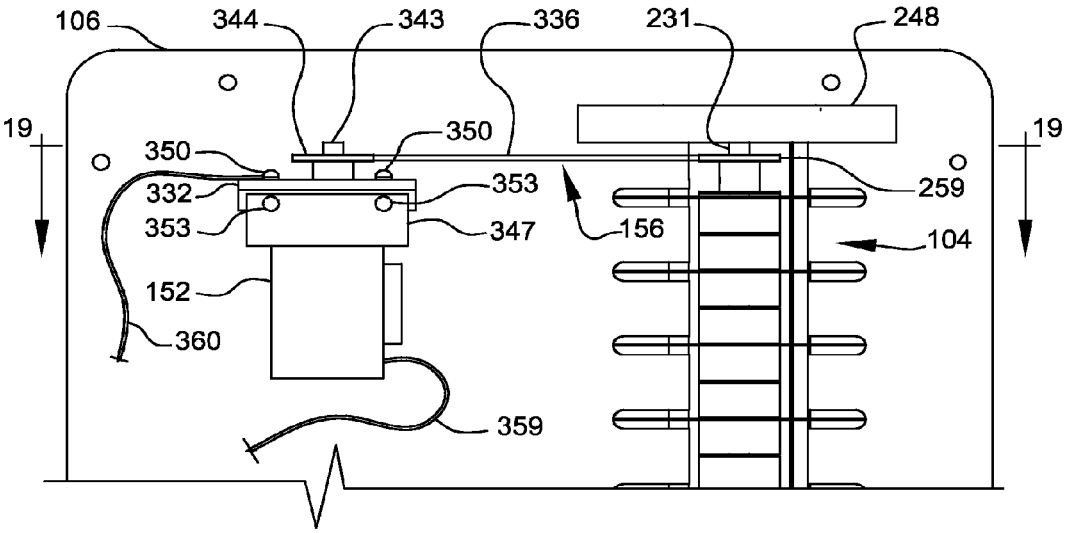
FIG. 18 shows partial underside view of the panel, illustrating a motor and chain drive, according to the embodiment of FIG. 17.
Figure 19:
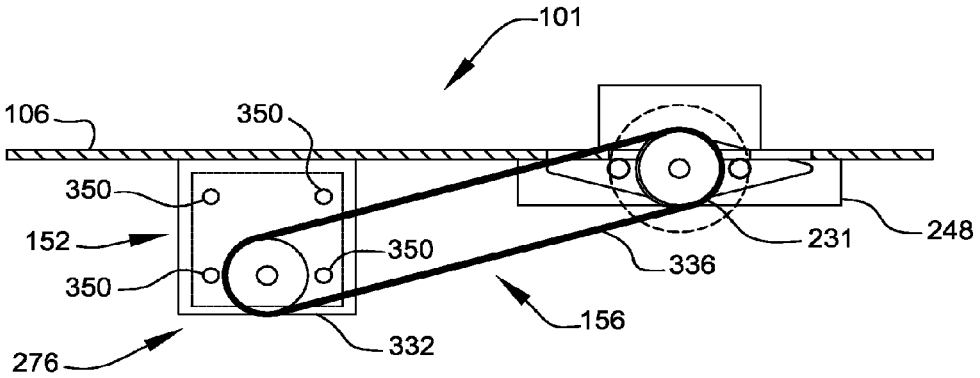
FIG. 19 is a sectional view through section 19-19 of FIG. 18, illustrating the motor and chain drive.

FIG. 18 is a partial underside view of panel 106 illustrating mechanical power subsystem 276, according to the embodiment of FIG. 17. FIG. 19 shows the sectional view 19-19 of FIG. 18, illustrating mechanical power subsystem 276. Panel 106 encloses mechanical power subsystem 276, and motor electrical connections in lower portion 173 of briefcase enclosure 108, as shown in FIG. 4. Panel 106 also allows for easy mounting of magnetizer array 104 and mechanical power subsystem 276. Panel 106 also provides simplified access to maintain magnetizer assembly 101. In the event magnetizer assembly 101 requires maintenance or repairing, panel 106 is removed for access to components of magnetizer assembly 101. Mechanical power subsystem 276 comprises motor 152 and chain drive 156. Motor 152 comprises an electric motor, such as McMaster-Carr A/C Gear Motor Part #6142K57. McMaster-Carr A/C Gear Motor Part #6142K57 is available from McMaster-Carr, Elmhurst, Ill. 60126. Motor 152 also comprises gearbox 347 and a built in motor fan. Motor 152 is attached to angle bracket 332 by motor-mount screw 350. Angle bracket 332 is attached to panel 106 by motor-bracket screws 353.

Chain drive 156 connects motor 152 to gear-drive endplate 259 on magnetizer array 104. Chain drive 156 comprises chain 336, gear-drive endplate 259, at least one motor-shaft 343, and motor-gear 344. Motor 152 connects to at least one gearbox 347. Gearbox 347 connects to motor shaft 343. Motor-shaft 343 connects to motor-gear 344. Chain 336 connects motor-gear 344 to gear-drive endplate 259 on shaft 231. Motor 152 comprises motor-power wire 359, motor grounding wire 360, connected to fuse 177, power cord receptacle 122 and power switch 131 (see FIG. 1). Fuse 177, power cord receptacle 122, and power switch 131, are attached to briefcase enclosure 108 as best shown in FIG. 1. Portable magnetizer 105 is fused for safety. Motor 152 is wired to fuse 177, power cord receptacle 122, and power switch 131 in conventional electrical configuration.

Power switch 131 activates motor 152. Motor 152 sends mechanical power to gearbox 347. Gearbox 347 transfers power to motor-shaft 343 and motor-gear 344. Motor-gear 344 moves chain 336. Motor-gear 344 drives gear-drive endplate 259 at about a one-to-one revolution ratio. Rotation of gear-driven endplate 259 drives shaft 231 and magnetic roller 133.

Figure 20:
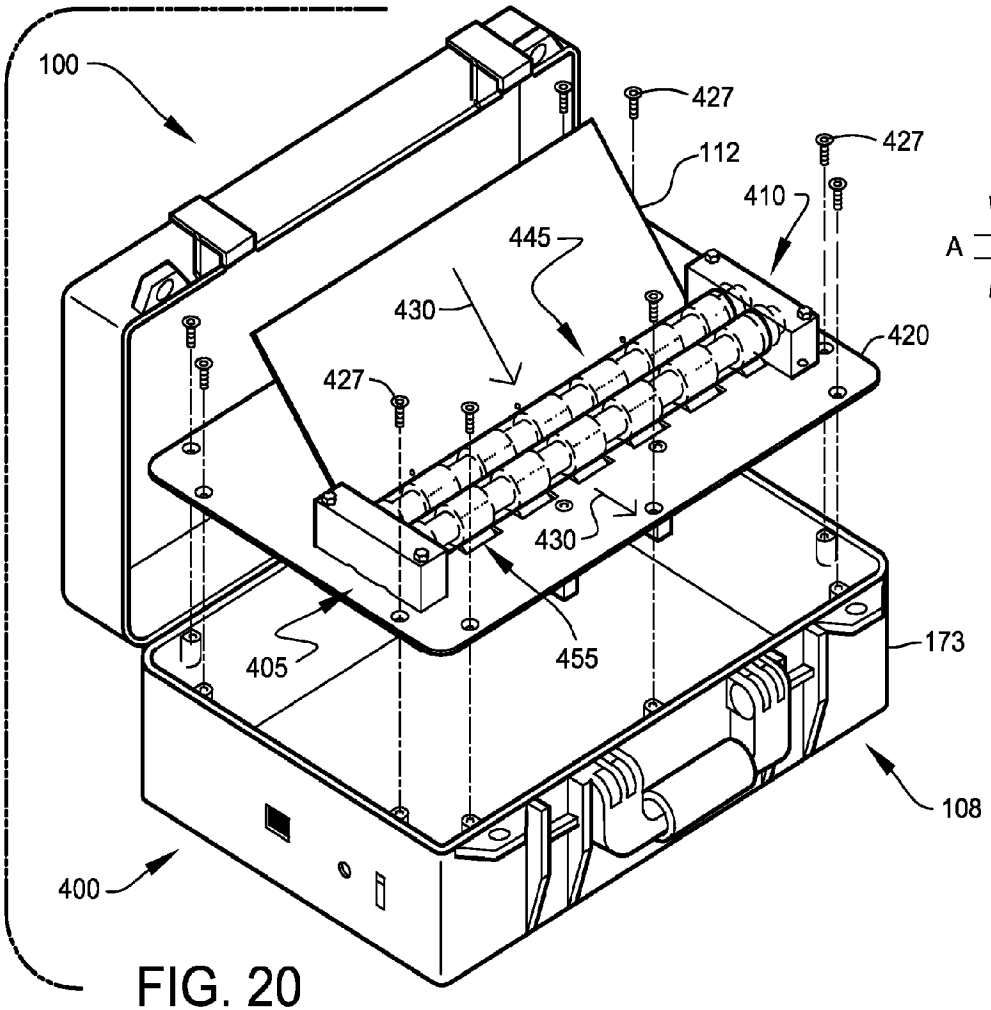
FIG. 20 shows a partial-exploded perspective view illustrating a high-energy portable magnetizer according to another embodiment of the present invention.

FIG. 20 is a partial-exploded perspective view illustrating high-energy portable magnetizer 400 according to an alternate embodiment of the present invention. As many of the elements of high-energy portable magnetizer 400 are retained from portable magnetizer 105, only structures and arrangements on the present embodiment differing from the prior embodiment will be described.

Figure 21:
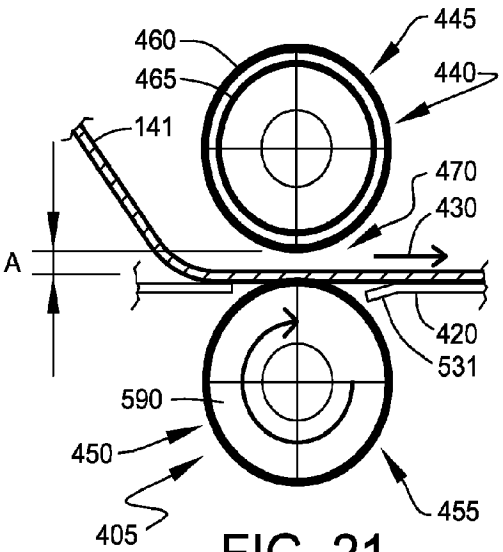
FIG. 21 is a diagrammatic side view, illustrating a feed path through a high-energy portable magnetizer, according to the embodiment of FIG. 20.

High-energy portable magnetizer 400 replaces magnetizer array assembly 205 of portable magnetizer 105 with high-energy magnetizer array assembly 405. High-energy magnetizer array assembly 405 comprises upper magnetic field source 445 and lower magnetic field source 455, as diagrammatically shown in FIG. 21. FIG. 21 shows a diagrammatic side view, illustrating feed path 430 extending through high-energy magnetizer array assembly 405, according to the embodiment of FIG. 20. Lower magnetic field source 455 comprises magnetic roller assembly 450, as shown. Upper magnetic field source 445 comprises at least one magnetic bar assembly 440. The upper magnetic bar assembly 440 and the lower magnetic roller assembly 450 are situated to form gap 470 therebetween. Gap 470 comprises a distance A of about ⅛ inch. Feed path 430 extends through gap 470 in a orientation about perpendicular to the longitudinal axes of magnetic bar assembly 440 and magnetic roller assembly 450, as shown. Due to the relative positions of magnetic bar assembly 440 and magnetic roller assembly 450, gap 470 comprises at least one region of high magnetic flux.

Feed tray 112 (see FIG. 20) functions to assist the positioning of flexible magnetic sheet 141 in an initial position within feed path 430. In addition, feed tray 112 assists in guiding flexible magnetic sheet 141 toward gap 470 and the lower magnetic roller assembly 450. The lower magnetic roller assembly 450 is configured to drive flexible magnetic sheet 141 along feed path 430 through gap 470, similar to the previously-described magnetic roller 133.

Figures 22, 23:
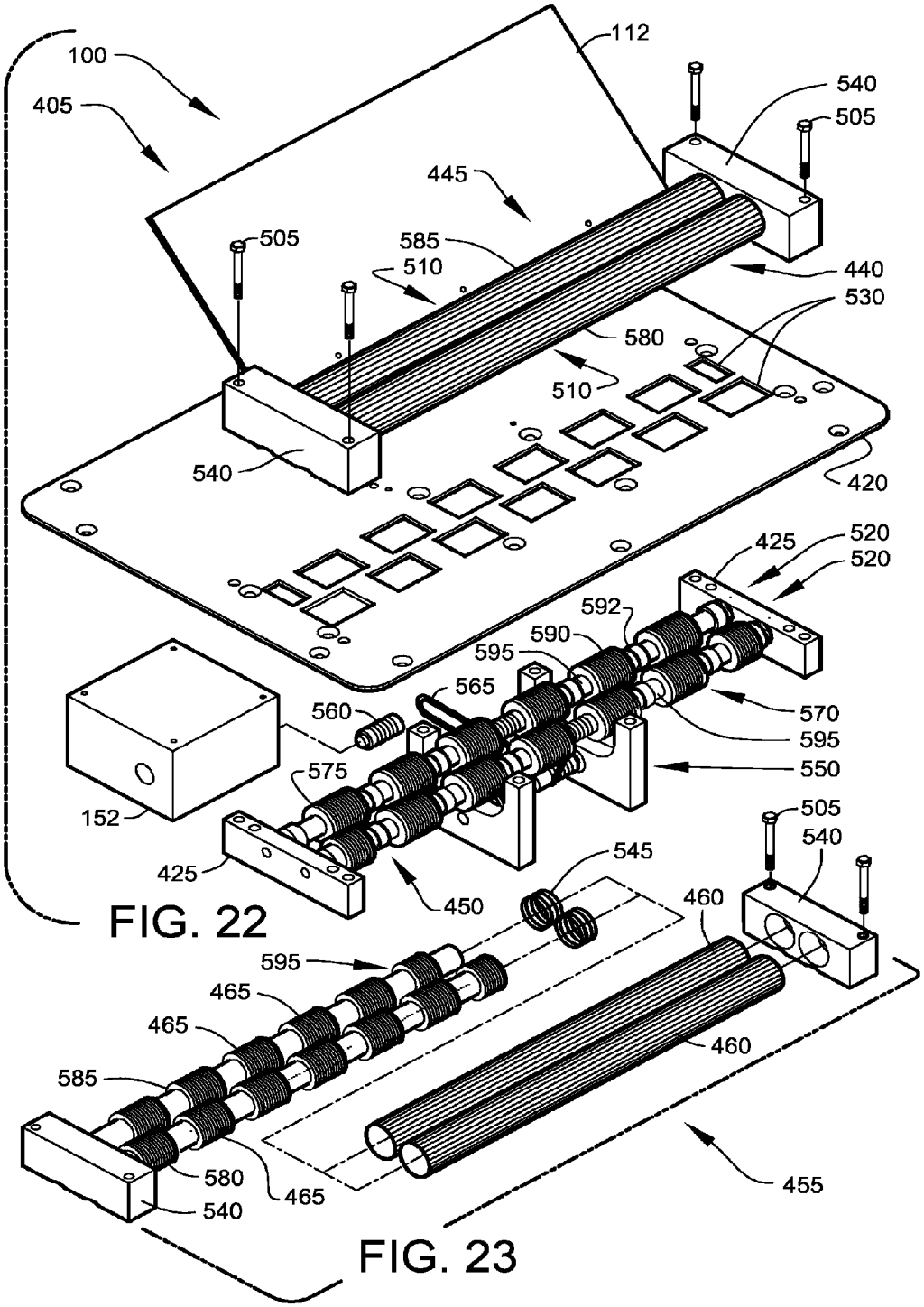
FIG. 22 is an isometric exploded view, illustrating a high-energy magnetizer array assembly, according to the embodiment of FIG. 21.
FIG. 23 shows an isometric exploded view, illustrating an upper magnetizer array subassembly, according to the embodiment of FIG. 22.

FIG. 22 is an isometric exploded view, further illustrating high-energy magnetizer array assembly 405, according to the embodiment of FIG. 21. FIG. 23 is an isometric exploded view, illustrating the arrangements of upper magnetic bar assembly 440, according to the embodiment of FIG. 22. Reference is now made to FIG. 22 and FIG. 23 with continued reference to FIG. 20 and FIG. 21.

The upper magnetic bar assembly 440 comprises at least one upper magnetizer array subassembly 510, and preferably at least two magnetizer array subassemblies 510, as shown. Magnetic bar assembly 440 comprises a smooth outer casing 460 and a magnetic stack 465 contained within outer casing 460. Outer casing 460 comprises magnetically transparent material (e.g., material that does not significantly attenuate a magnetic field passing through it), such as brass. Other magnetically transparent materials, such as, for example, magnetically-transparent plastics, magnetically-transparent ceramics, other magnetically transparent metals, etc., may suffice.

Correspondingly, the lower magnetic roller assembly 450 comprises at least one magnetizer array subassembly 520, and preferably at least two magnetizer array subassemblies 520, as shown. The functional relationship between the two lower magnetizer array subassemblies 520 is representative of the functional relationship between the two upper magnetizer array subassemblies 510. For conciseness and clarity of description, the functional relationship between the two magnetizer array subassemblies 520 will be discussed with the understanding that the teachings are equally applicable to the functional relationship between the two upper magnetizer array subassemblies 510.

Each magnetizer array subassembly 520 comprises leading magnetic roller 575 and trailing magnetic roller 570. Each upper magnetizer array subassembly 510 comprises leading magnetic bar 585 and at least one trailing magnetic bar 580. Both magnetic roller assemblies 450 and magnetic bar assemblies 440 extend across substantially the full width of feed path 430 and flexible magnetic sheet 141. Leading magnetic roller 575 comprises rotational shaft 595 oriented substantially perpendicular to the line of direction of feed path 430 (as generally defined by the direction of sheet motion), as shown. Leading magnetic roller 575 comprises a first set of magnetic stacks 590, spaced substantially along the length of rotational shaft 595, as shown.

Each magnetic stack 590 comprises an alternating sequence of magnetic plates and flux-conducting plates in a configuration matching those of the previously-described magnetic stacks 239 shown and described in FIG. 8A and FIG. 8B. Each magnetic plate comprises a high-strength permanent magnet and each flux-conducting plate comprises a material exhibiting high permeability when saturated. Both magnetic plates and flux-conducting plates comprise substantially circular peripheral shapes. Each substantially circular magnetic plate and each substantially circular flux-conducting plate are substantially coaxial with rotational shaft 595, as shown. Thus, the sequential laminations of each magnetic stack 590 form a substantially cylindrical peripheral surface.

Magnetic stacks 590 are mounted coaxially on rotational shaft 595, as shown. Magnetic stacks 590 are separated by a set of spacers 592 that are also mounted coaxially on rotational shaft 595, as shown. Spacers 592 comprise widths generally slightly shorter than those of magnetic stacks 590, as shown. As in the prior magnetic stacks 239, magnetic stacks 590 each comprise a 16-PPI stack 237, as shown in FIG. 8A. Magnetic stacks 590 for high-energy magnetizer array assembly 405 comprise a length of about 1⅛ inch. Spacers 592 comprise a width of about 1 inch. The structures and arrangements of the upper leading magnetic bar 585 are substantially identical to those of the lower leading magnetic roller 575, as described above. The placements of magnetic stacks 465 along rotational shaft 595 of leading magnetic bar 585 are substantially identical to those of leading magnetic roller 575. This places magnetic stacks 465 of leading magnetic bar 585 in vertical alignments with magnetic stacks 590 of leading magnetic roller 575. Thus, a plurality of first high-magnetic-flux field regions (six in the depicted embodiment) are generated within the leading gap 645 (see FIG. 26) by the vertical stacking of leading magnetic roller 575 below leading magnetic bar 585 and the resulting formation of magnetic flux circuits between leading magnetic roller 575 and leading magnetic bar 585.

The structures and arrangements of trailing magnetic roller 570 are substantially similar to those of leading magnetic roller 575, with the exception of the positioning of magnetic stacks 590 along rotational shaft 595, as shown. Note that magnetic stacks 590 of trailing magnetic roller 570 are axially offset from magnetic stacks 590 of leading magnetic roller 575. More, magnetic stacks 590 of trailing magnetic roller 570 are axially offset a distance substantially equal to the width of one magnetic stack 590, as shown (similarly, magnetic stack 465 of the upper trailing magnetic bar 580 are axially offset from magnetic stack 465 of the upper leading magnetic bar 585), centering magnetic stacks 590 of leading magnetic roller 575 on spacers 592 of trailing magnetic roller 570. This arrangement produces a plurality of second high-magnetic-flux field regions (seven in the depicted embodiment) within trailing gap 640 (see FIG. 26), each of such second high-magnetic-flux field regions generated by the vertical stacking of trailing magnetic roller 570 below trailing magnetic bar 580. Note that the plurality of such second high-magnetic-flux field regions of trailing gap 640 are axially offset from the plurality of such first high-magnetic-flux field regions of leading gap 645.

The axial offsetting of the above-described magnetic stacks assures that the full width of flexible magnetic sheet 141 is exposed to of the above-described high-magnetic-flux field regions as it is advanced along feed path 430, as shown. Thus, magnetization of flexible magnetic sheet 141 occurs in parallel strips defined by alternating exposure to the magnetic fields of the leading and trailing magnetic rollers. The axial offsetting of the depicted embodiment has been determined to reduce feed-related problems related to the adhering and wrapping of flexible magnetic sheet 141 around the magnetic rollers during operation. Other magnet arrangements, such as utilizing a continuous array of magnets extending substantially across the sheet width, etc., may suffice.

High-energy magnetizer array assembly 405 comprises magnetizer array plate 420. Magnetizer array plate 420 mounts to lower portion 173 of briefcase enclosure 108, as shown, with mounting fasteners 427 (see FIG. 20), mounting screws. Under appropriate circumstances, considering such issues as future technologies, cost, etc., other mounting fasteners, such as, for example, bolts, snap-fit fasteners, twist-lock fasteners, etc., may suffice. Magnetizer array plate 420 includes a set of rectangular-shaped apertures 530, arranged in an offset configuration, as shown, corresponding to layout of magnetic stacks 590 of leading magnetic roller 575 and trailing magnetic roller 570. Rectangular-shaped apertures 530 allow the magnetic stacks 590 of magnetic roller assembly 450 to project upwardly through magnetizer array plate 420 to contact flexible magnetic sheet 141, as shown in FIG. 21.

In one embodiment of the system, the trailing edge of each aperture 530 and opening comprises an angled ramp 531, as diagrammatically shown in FIG. 21. Such angled ramps assist in maintaining smooth and consistent feed performance by reducing the tendency of flexible magnetic sheet to contact the trailing edge of the apertures due to magnetic adherence to the magnetizer banks, each angled ramp comprises a tapered cut within the plate. More specifically, the angled ramps are formed by modifying a section of the plate to allow bending of the trailing edge of the aperture downward, as diagrammatically shown in FIG. 21.

The upper magnetic bar assembly 440 mounts above magnetizer array plate 420, outside lower portion 173 of briefcase enclosure 108. The lower magnetic roller assembly 450 mounts below magnetizer array plate 420, inside lower portion 173 of briefcase enclosure 108. Magnetizer array mounting fastener 505 secures both the upper magnetic bar assembly 440 and the lower magnetic roller assembly 450, by passing through magnetizer array plate 420, as shown. Magnetizer array mounting fastener 505 comprises a bolt. Magnetizer array mounting fastener 505 secures lower mounting bracket 425 to upper mounting bracket 540, sandwiching magnetizer array plate 420 therebetween. At least two lower mounting brackets 425 hold the lower magnetizer array subassemblies 520, and at least two upper mounting brackets 540 hold the upper magnetizer array subassemblies 510 in operable positions, as shown.

Each of the upper magnetizer array subassemblies 510 further comprise at least one roller float spring 545, at least two roller float springs 545. Roller float springs 545 are positioned at each end of a respective magnetic bar, inside outer casing 460. Roller float springs 545 allow the series of magnetic stacks 465 to shift in a longitudinal direction, to magnetically align with the lower magnetic stacks 590. In one arrangement, outer casing 460 is free to rotate in upper mounting bracket 540 and the internal magnetic bar is free to longitudinally slide inside outer casing 460. Leading magnetic bar 585 and trailing magnetic bar 580 are thereby free to translate in order to achieve optimal alignment with the upper and lower magnetic stacks, thus optimizing the high-magnetic-flux regions, as described herein. Under appropriate circumstances, considering such issues as cost, future technologies, etc., other mounting arrangements, such as, for example, vertically shifting outer casings, fine gap adjustments, etc., may suffice.

Figures 27B, 28:
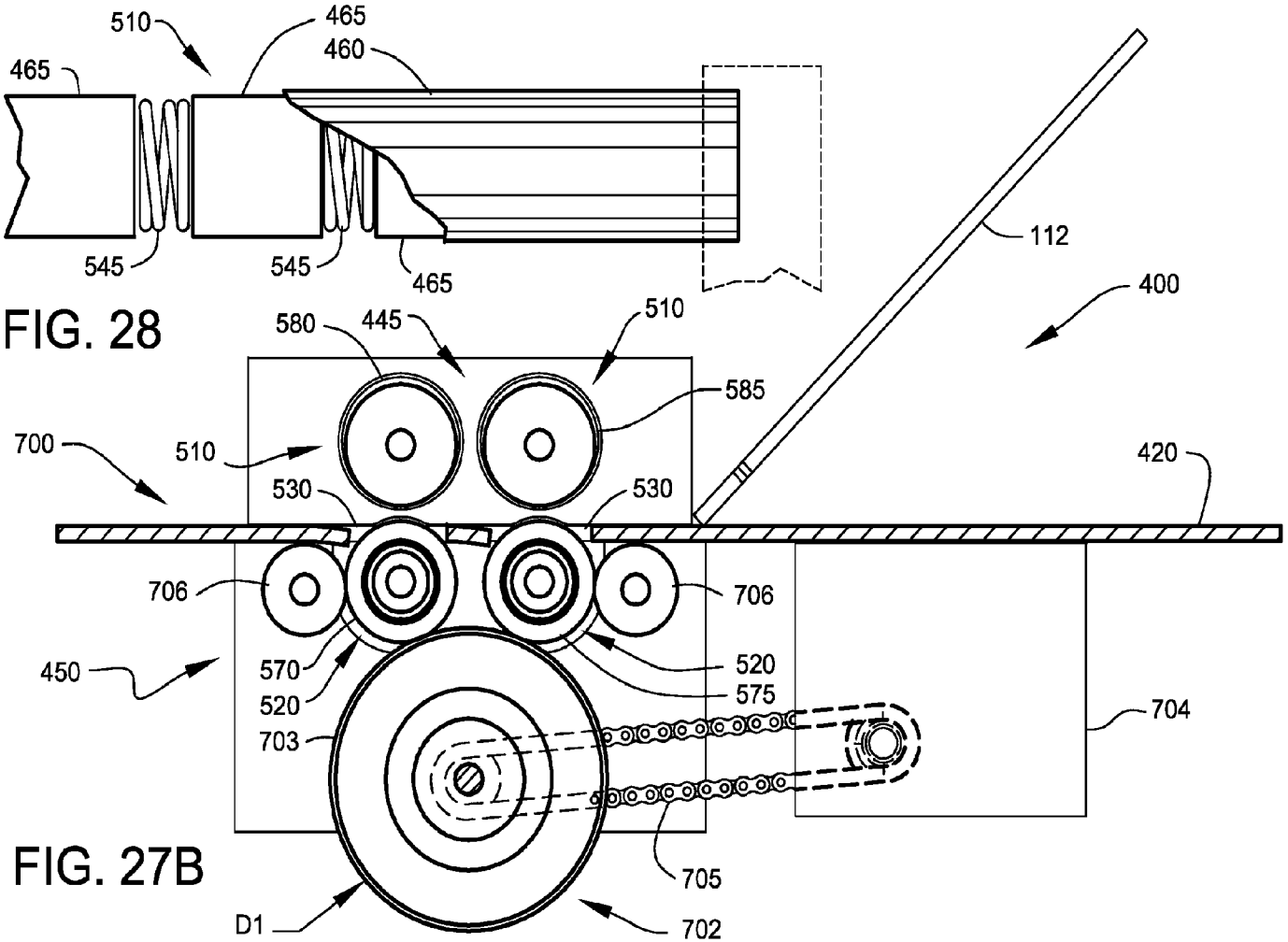
FIG. 27B is a sectional view through section 27B-27B of FIG. 27A, illustrating the alternate rotational drive subassembly of FIG. 27A
FIG. 28 is a partial cut-away front view, illustrating an alternate high-energy magnetizer array assembly, according to yet another embodiment of the present invention.

Alternately, each magnetic stack 465 of the upper magnetizer array subassemblies 510 are separated by a roller float spring 545, as illustrated in FIG. 28. This alternate arrangement permits each magnetic stack 465 of the upper magnetic bars to align with a corresponding magnetic stack 590 of the adjacent of lower magnetizer array subassembly 520. The lower magnetic roller assembly 450 connects to motor 152 with rotational drive subassembly 550. Motor 152 attaches to motor drive shaft 560, and rotates motor drive shaft 560 during operation. Motor drive shaft 560 attaches to rotational drive subassembly 550 with motor drive belt 565, as shown. Under appropriate circumstances, considering such issues as cost, future technologies, etc., other drive train connections, such as, for example, chains, gears, rollers, etc., may suffice.

Figure 24:
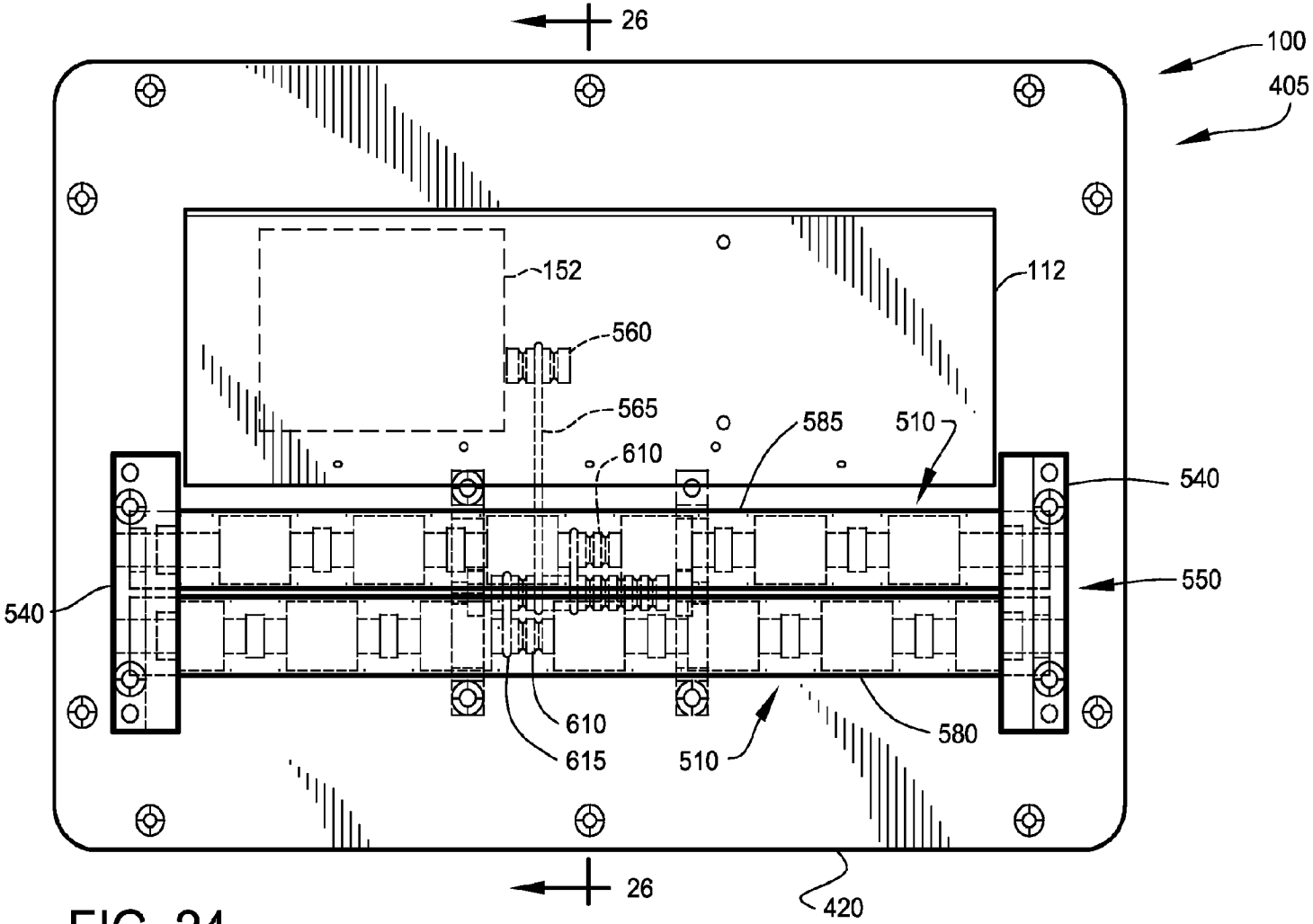
FIG. 24 is a top view of the high-energy magnetizer array assembly, illustrating a rotational drive subassembly, according to the embodiment of FIG. 23.
Figure 25:
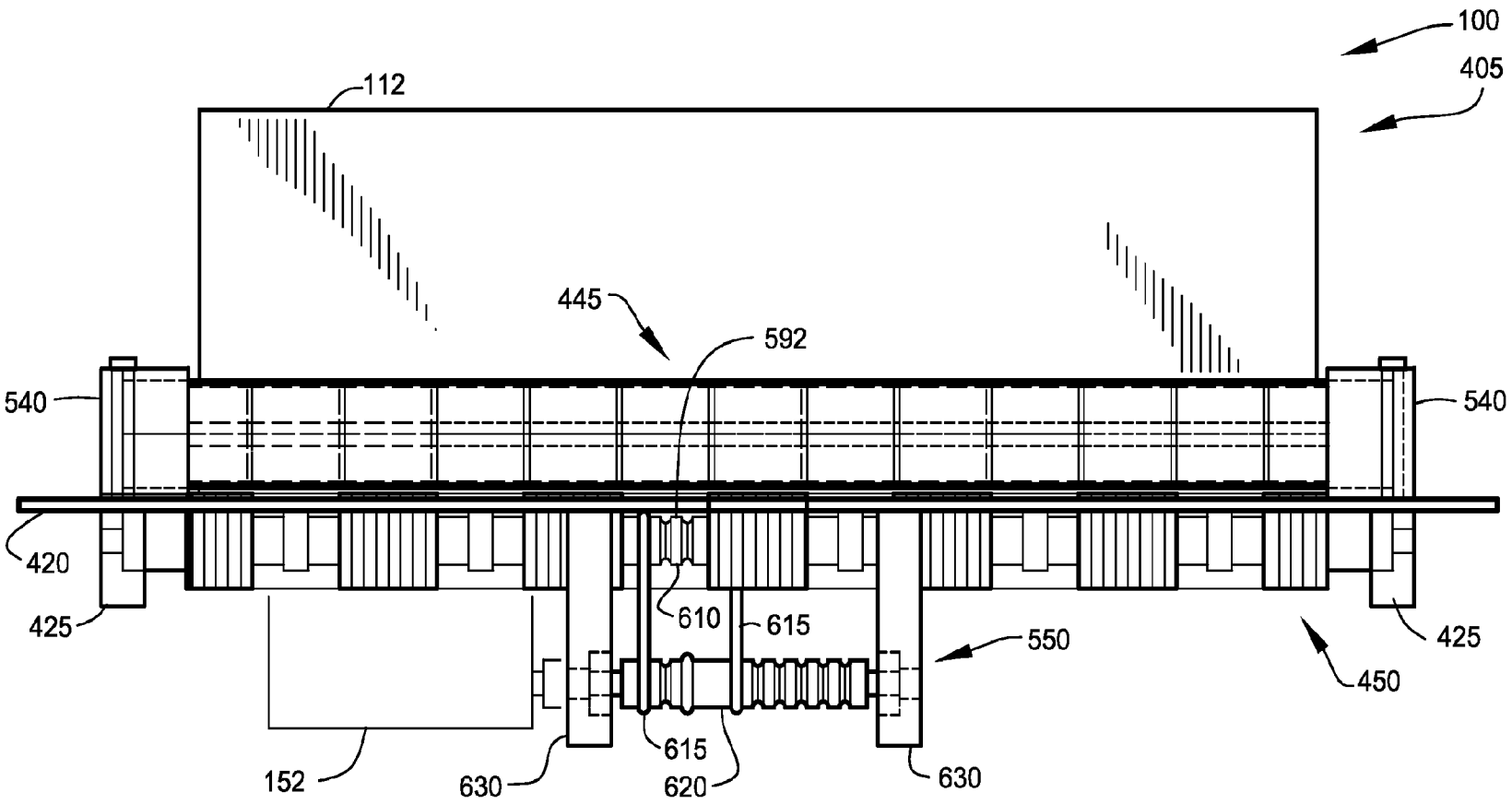
FIG. 25 is a front view of the high-energy magnetizer array assembly, illustrating the rotational drive subassembly, according to the embodiment of FIG. 23.
Figure 26:
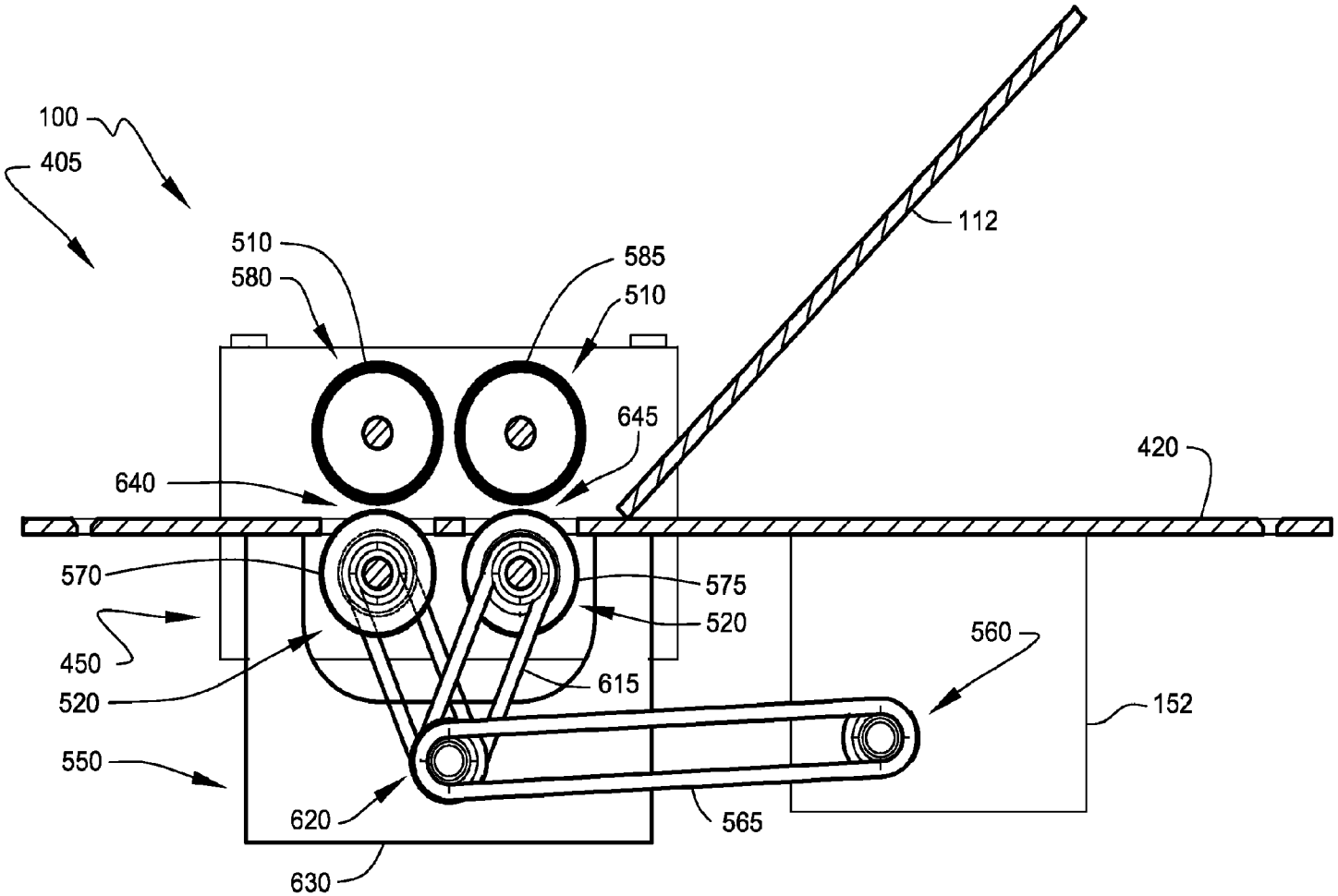
FIG. 26 is a sectional view through section 26-26 of FIG. 24, illustrating the high-energy magnetizer array assembly.

FIG. 24 shows a top view of high-energy magnetizer array assembly 405, illustrating rotational drive subassembly 550, according to the embodiment of FIG. 22. FIG. 25 shows a front view of high-energy magnetizer array assembly 405, illustrating rotational drive subassembly 550, according to the embodiment of FIG. 22. FIG. 26 shows the sectional view 26-26 of FIG. 24, illustrating rotational drive subassembly 550. Rotational drive subassembly 550 comprises drive assembly mount 630, roller drive shaft 620, and roller drive belt 615. Rotational drive assembly 550 transfers rotations motion from motor 152 to magnetic roller assembly 450, in a 1:1 ratio. Under appropriate circumstances, considering such issues as cost, future technologies, etc., other rotational drive assemblies, such as, for example, gear boxes, direct drives, chain drives, friction roller drives, etc., may suffice.

Drive assembly mount 630 mounts roller drive shaft 620 under magnetic roller assembly 450, as shown in FIG. 25. Roller drive belt 615 connects roller drive shaft 620 to magnetic roller assembly 450, transferring rotational motion during operation. Each magnetic roller comprises drive spacer 610, where roller drive belt 615 attaches, comprising of spacers 592. Motor drive belt 565 transfers rotational motion from motor drive shaft 560 to roller drive shaft 620, during operation.

Figure 27A:
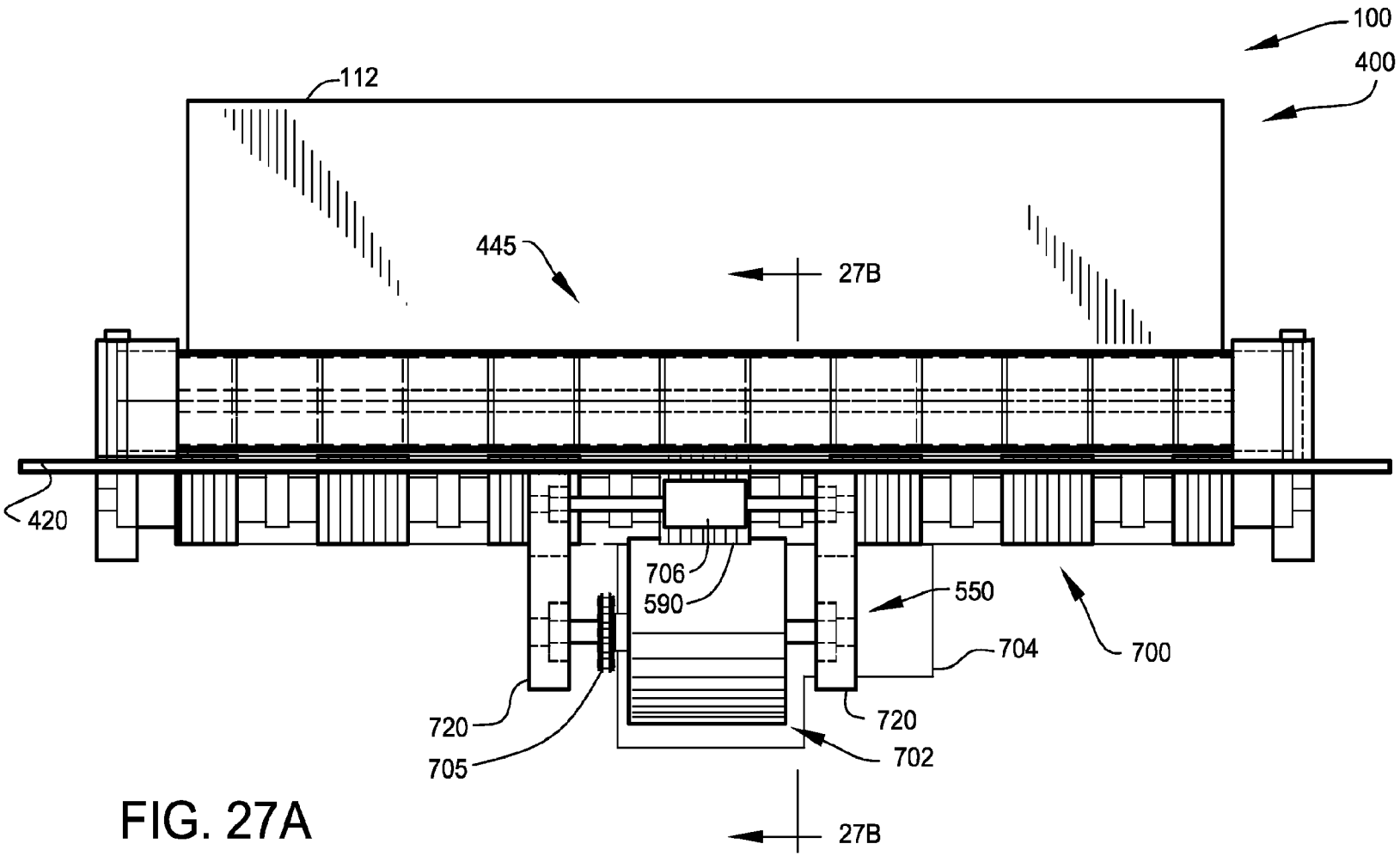
FIG. 27A is a front view of an alternate high-energy magnetizer array assembly, illustrating an alternate rotational drive subassembly, according to another embodiment of the present invention.

FIG. 27A shows a front view of an alternate high-energy portable magnetizer 400, modified to comprise alternate rotational drive subassembly 700, according to another embodiment of the present invention. FIG. 27B shows the sectional view 27B-27B of FIG. 27A, illustrating the alternate rotational drive subassembly 700 of FIG. 27A. Alternate rotational drive subassembly 700 differs from the prior embodiment in that magnetic roller assembly 450 is driven by a large-diameter shaft-mounted drive roller 702, as shown. Drive roller 702 comprises a resilient outer surface 703, as shown. Resilient outer surface 703 of drive roller 702 comprises synthetic rubber, a urethane material having a 35A durometer hardness. Drive roller 702 comprises an outer diameter D1 of about 2½ inches. One urethane roller suitable for use as drive roller 702 comprises a unit having a width of about 1.9 inches and an internal bore of about 1 inch, a McMaster-Carr urethane roller Part number 2475K104 available from McMaster-Carr, Elmhurst, Ill. Drive roller 702 is configured to be coupled to motor 704 by chain drive 705, as shown. In this alternate arrangement, motor 704 comprises a motor such as a McMaster-Carr AC Gear motor, part number 6142K58, providing about 75 revolutions per minute, about 10-inch pounds of torque, and operating on a 115 volt alternating circuit.

Drive roller 702 is mounted to the underside of magnetizer array plate 420 by a set of side-positioned mounting plates 720, as shown. Mounting plates 720 are configured to support drive roller 702 while providing clearance to accommodate free rotation of magnetic roller assembly 450. This mounting arrangement places the resilient outer surface 703 of drive roller 702 in direct contact with one or more magnetic stacks 590 of the lower magnetic roller assembly 450, as shown. Rotation of leading magnetic roller 575 and trailing magnetic roller 570 is induced by the operation of motor 704 acting through chain drive 705 and drive roller 702.

In addition, alternate rotational drive subassembly 700 comprises a set of rotatable magnet stay rollers 706, configured to limit load deflections and maintain positioning of leading magnetic roller 575 and trailing magnetic roller 570 within magnetic roller assembly 450 during operation. Deflection within each magnetic roller is limited by the application of a force to the lower magnetic roller assembly 450 opposing the upward force applied to magnetic roller assembly 450. Magnet stay rollers 706 are located adjacent each magnetic roller, in front of leading magnetic roller 575 and behind trailing magnetic roller 570, as shown. Magnet stay rollers 706 may comprise rollers such as McMaster-Carr Part number 2473K22, which is a press-fit drive roller having about a ¾-inch outer diameter and about a ¾-inch width with a ¼-inch inside bore diameter. Magnet stay rollers 706 are rotatably supported within the support of side mounting plates 720, as shown.

The above-described arrangements of alternate rotational drive subassembly 700 have been found by applicant to provide improved performance in conjunction with the high-energy embodiments. In particular, the above-described arrangement of alternate rotational drive subassembly 700 provide reduced noise during operation, sufficient torque transfer within the high magnetic field pathway, and provides reduced wear in service.

Figures 29A, 29B:
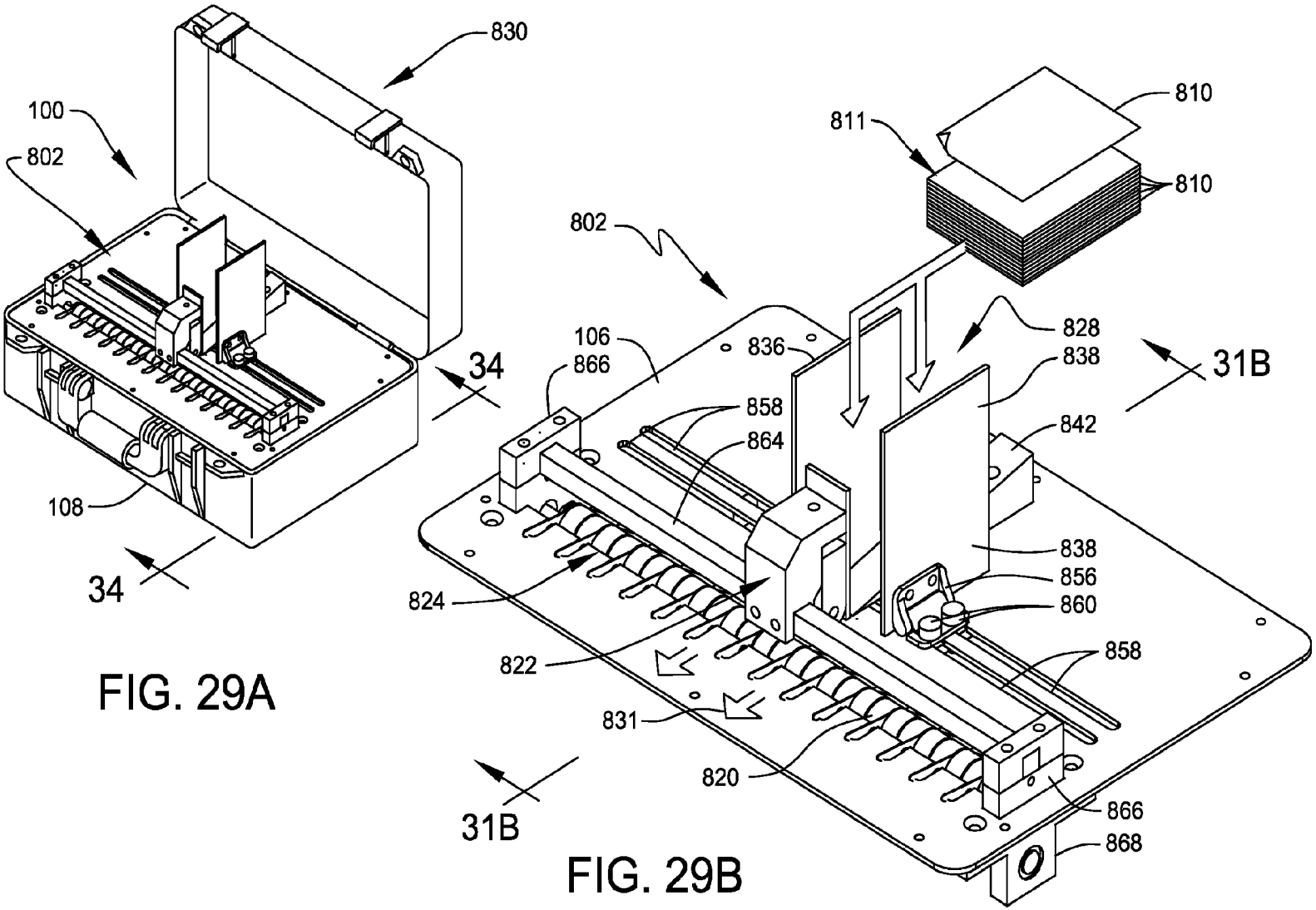
FIG. 29A is a perspective view, illustrating a multi-sheet feeder of the portable magnetizer system, integrated within a briefcase enclosure, according to an alternate embodiment of the present invention.
FIG. 29B is a perspective view, illustrating the multi-sheet feeder of the portable magnetizer system, separated from the briefcase enclosure, according to an alternate embodiment of the present invention.
Figure 30:
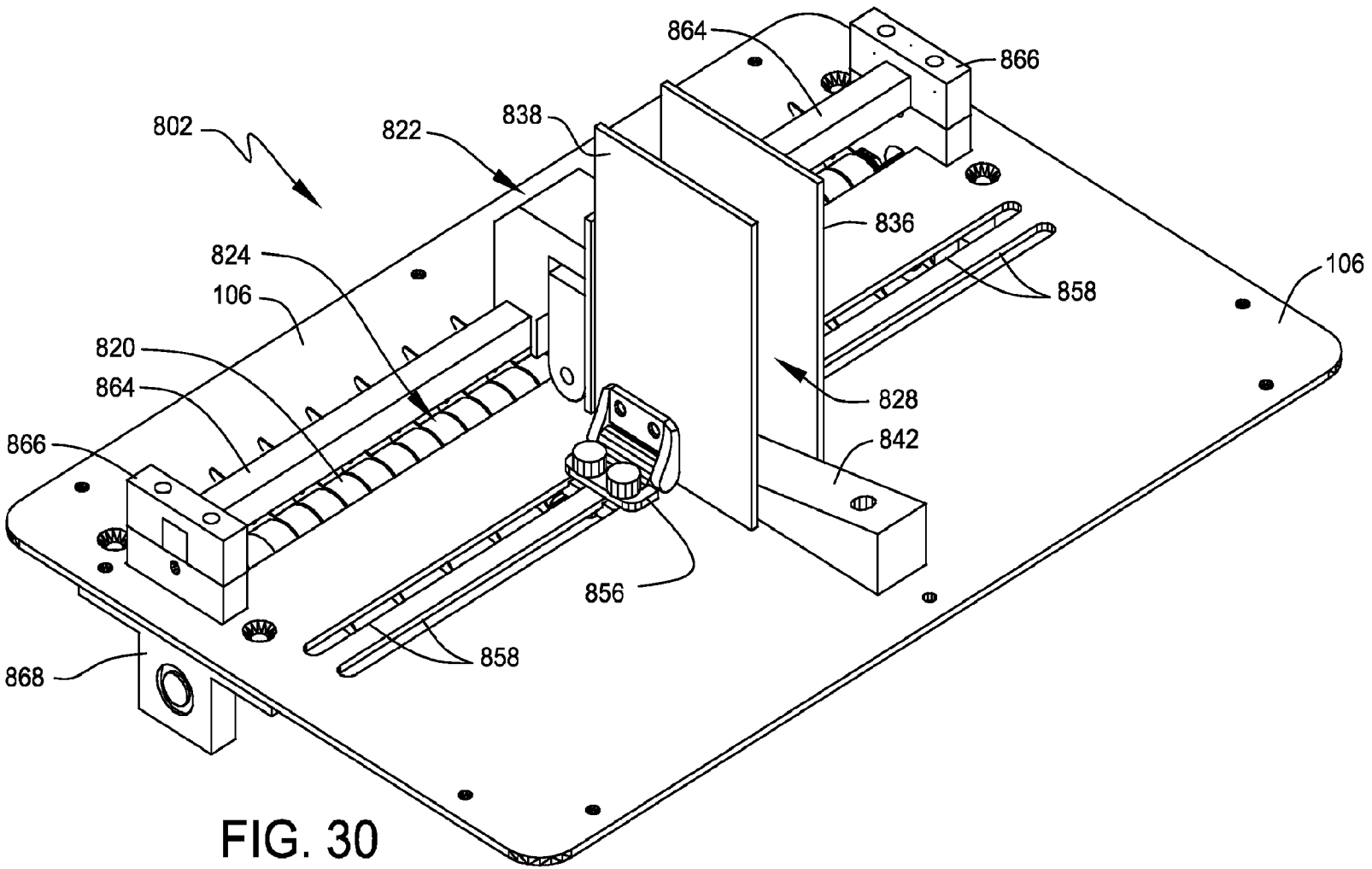
FIG. 30 is a rear facing perspective view, illustrating the multi-sheet feeder of the magnetizer sheet feeder system, according to the embodiment of FIG. 29A.

FIG. 29A is a perspective view illustrating multi-sheet feeder 802 of portable magnetizer system 100, integrated within a briefcase enclosure, according to a further alternate embodiment of the present invention. FIG. 29B is a perspective view illustrating multi-sheet feeder 802 of the magnetizer sheet feeder system 100 of FIG.29A, separated from the briefcase enclosure for clarity of description. FIG. 30 shows a rear facing perspective view of multi-sheet feeder 802 shown in FIG. 29B. Referring to FIG. 29A, FIG. 29B, and FIG. 30, multi-sheet feeder 802 is configured to implement single-sheet feeding of magnetizable sheets 810 from a stack of magnetizable sheets 811 and to permanently magnetize the sheets as they are advanced away from the stack. This stacked-sheet feeding capability differentiates multi-sheet feeder 802 from the prior-disclosed embodiments. It is noted that multi-sheet feeder 802 is combined with a briefcase enclosure 108 to form least one hand-carryable portable magnetizer 830, as shown.

Multi-sheet feeder 802 implements contemporaneous sheet-advancing functions and sheet magnetizing functions. Sheet-advancing functions are implemented by a group of components collectively identified as sheet-advancer 822 with sheet magnetizing functions implemented by a group of components generally identified as sheet-magnetizer 824. In this embodiment of the system, sheet-advancer 822 includes a sheet-feeder assistor for assisting singular sheet feeding of the magnetizable sheets through the magnetizer. Sheet magnetizer 824 is configured to permanently magnetize the magnetizable sheets 810 as they are advanced by the sheet advancer. In multi-sheet feeder 802, sheet-advancer 822 and sheet-magnetizer 824 share common components, in particular, a rotating magnetic array 820. Magnetic array 820 is configured to generate magnetic field 154 (as diagrammatically indicated by the dashed-line depiction of FIG. 31A). It is noted that the physical arrangements of magnetic array 820 are substantially similar to those of magnetizer array 104 of FIG. 1; thus, only the differences between rotating magnetic array 820 and the prior embodiment will be elaborated upon.

Figure 32:
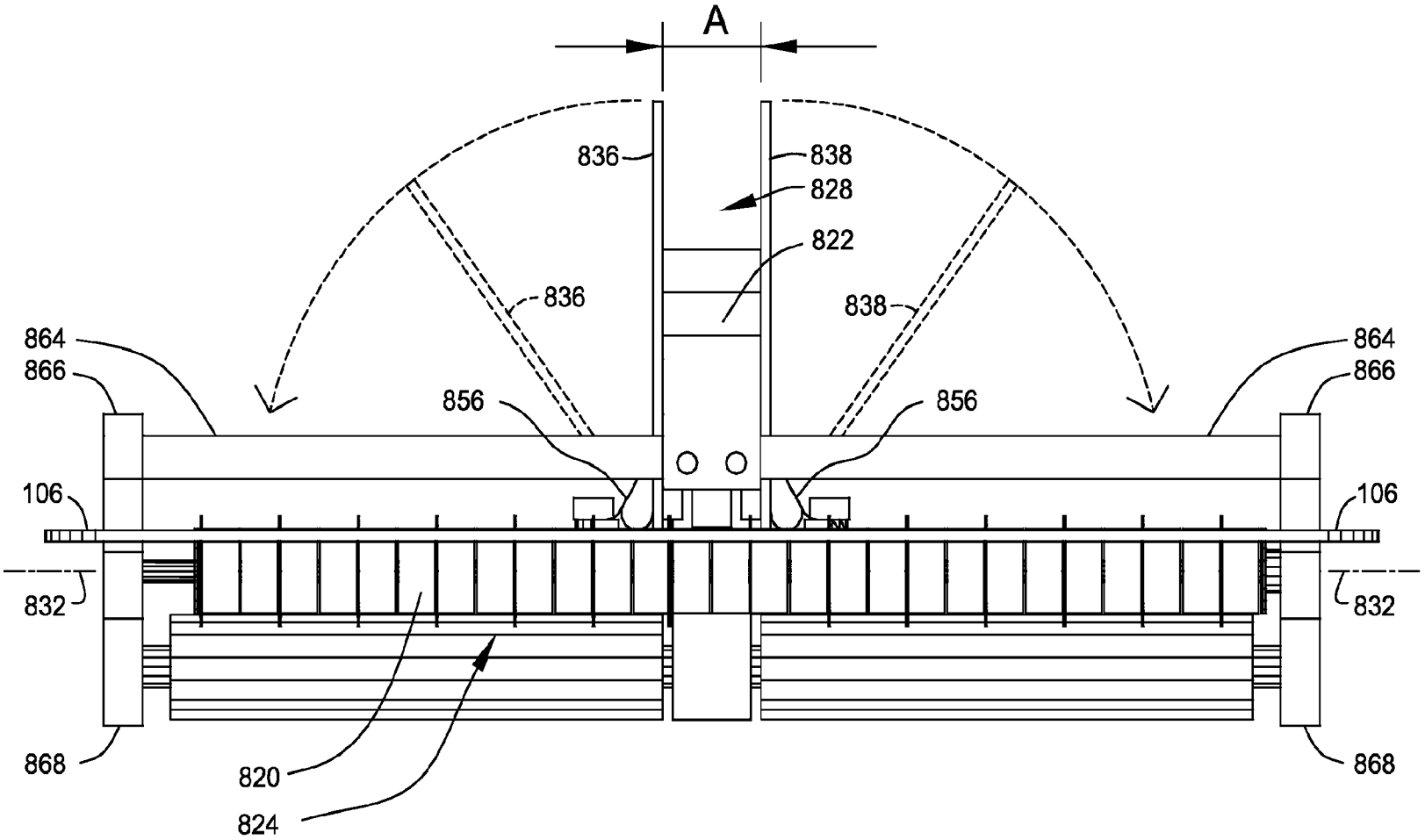
FIG. 32 is a front elevation view, further illustrating the multi-sheet feeder of portable magnetizer system, according to the embodiment of FIG. 29A.
Figure 33:
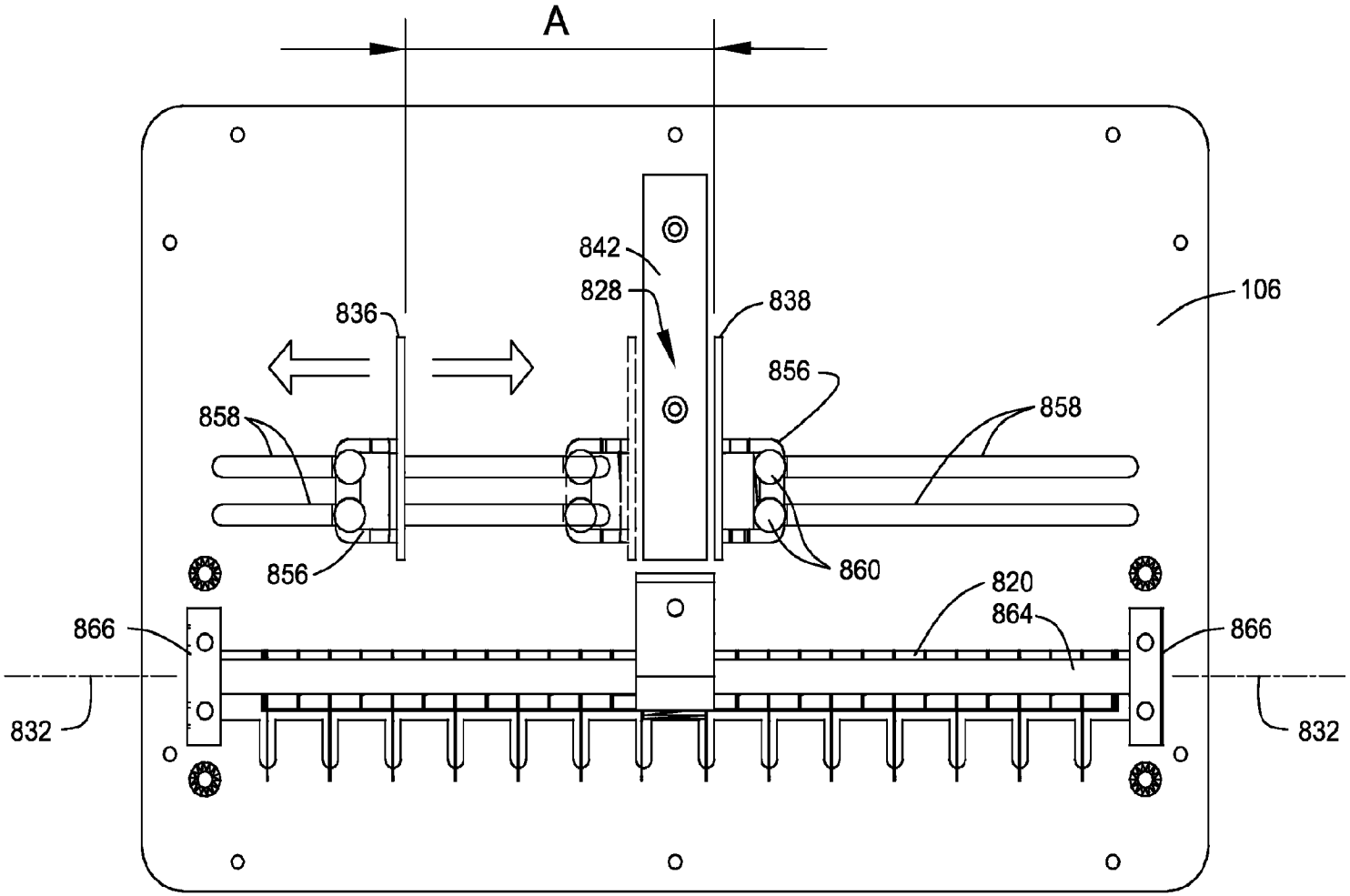
FIG. 33 is a top view, illustrating the multi-sheet feeder according to the embodiment of FIG. 29A.

Magnetic array 820 takes the form of a rotatably-mounted elongated bar having a longitudinal axis of rotation 832 oriented generally perpendicularly to the direction of sheet advancement along feed path 831 (see FIG. 32 and FIG. 33). Magnetic array 820 is coupled to a drive motor that is configured to rotate magnetic array 820 about longitudinal axis of rotation 832. As in the prior-described embodiments, magnetic array 820 is mounted below supportive panel 106 with a portion of magnetic array 820 protruding upwardly through panel 106, to permit direct contact with magnetizable sheets 810 in feed path 831 (i.e., the moving direction of the magnetizable sheets 810 advanced from stack 811). The physical components of sheet-advancer 822 are structured and arranged to advance single magnetizable sheets 810, one by one, from stack 811 located within a stack-positioning tray 828. Sheet-advancer 822 is configured to advance magnetizable sheets 810 from the bottom of stack 811 utilizing, in part, magnetic attraction between magnetizable sheets 810 and magnetic field 154 produced by magnetic array 820.

Figure 31A:
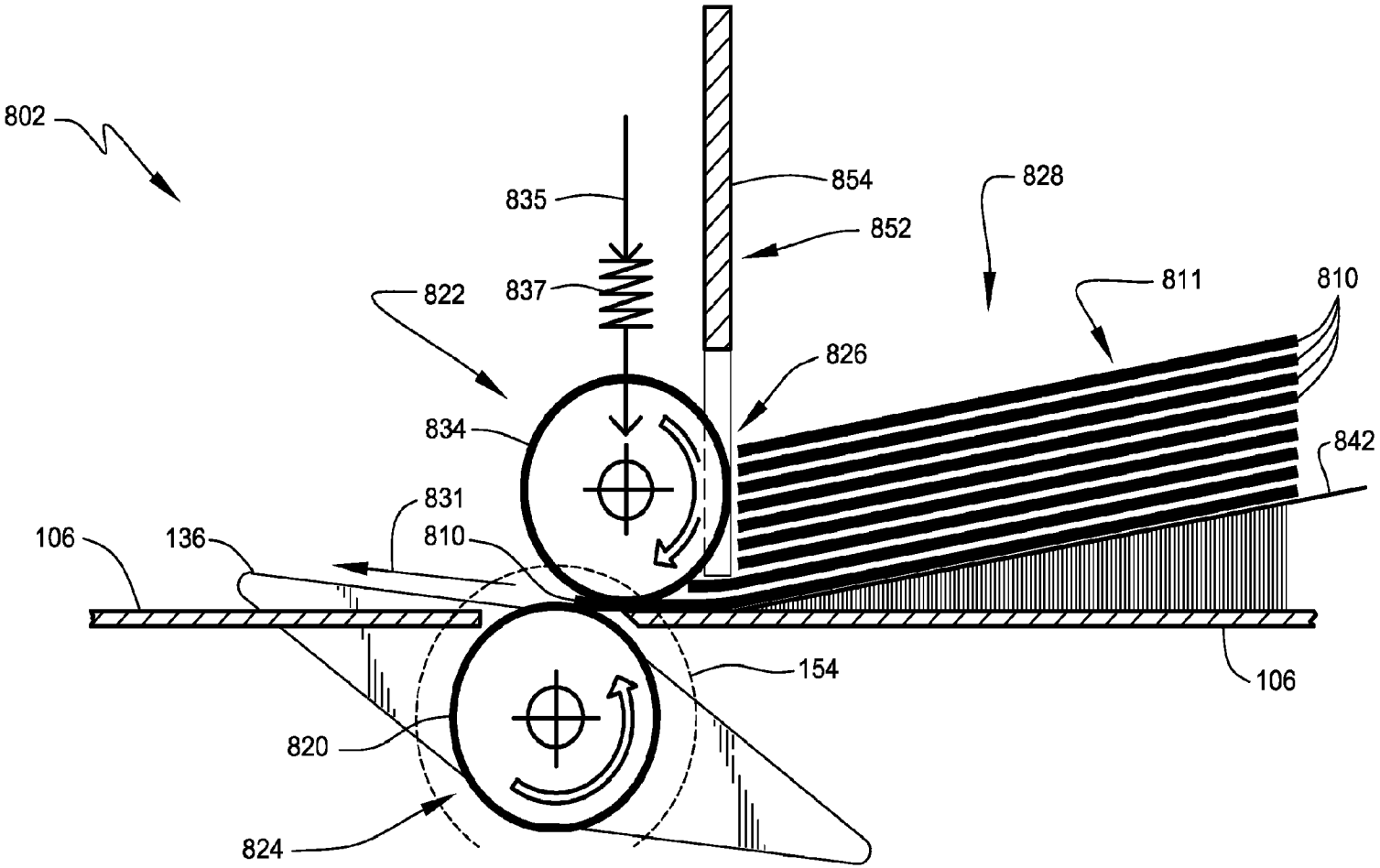
FIG. 31A is a side view, diagrammatically illustrating arrangements of a sheet separator according to the embodiment of FIG. 29A.

Stack-positioning tray 828 is configured to position stack 811 in relationship to sheet-advancer 822 so as to locate at least one of the magnetizable sheets 810 of stack 811 in interactive proximity with magnetic field 154 of sheet-advancer 822, as best illustrated in the diagrammatic and sectional views of FIG. 31A.

Stack-positioning tray 828 comprises two spaced-apart sidewalls to limit lateral movement of the sheets in stack 811 (relative to feed path 831). First sidewall 836 is configured to limit lateral movement of stack 811 in a first lateral direction. Second sidewall 838 is located opposite and substantially parallel to first sidewall 836, as shown, and is configured to limit lateral movement of stack 811 in a direction generally opposing the first lateral direction. Lower support of stack 811 within stack-positioning tray 828 is provided by panel 106. In an exemplary arrangement of the present embodiment, sloping surface 842 is located at the base of stack-positioning tray 828 between first sidewall 836 and second sidewall 838, as shown. Sloping surface 842 comprises a wedge-shaped member mounted to panel 106, as shown. Sloping surface 842 is configured to bias magnetizable sheets 810 of stack 811 toward sheet-magnetizer 824.

Figure 31B:
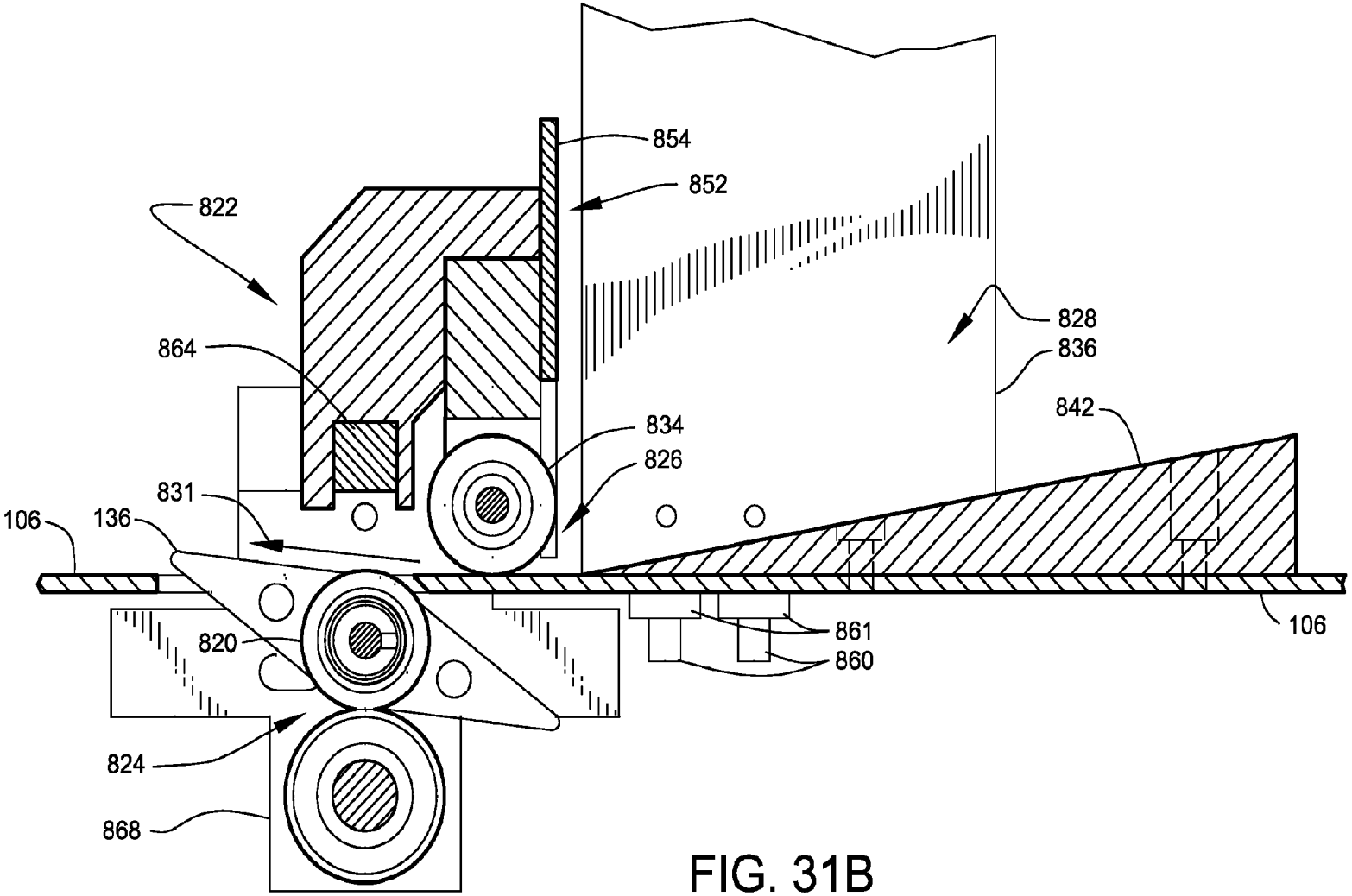
FIG. 31B is a sectional view, through the section 31-31 of FIG. 29B, illustrating a sheet separator arrangement according to the embodiment of FIG. 29A.

Referring to FIGS. 31A-31B, the separation of single magnetizable sheets 810 from stack 811 is implemented by a set of components identified as sheet separator 826. FIG. 31A is a side view, diagrammatically illustrating an arrangement of sheet separator 826, according to the embodiment of FIGS. 29A-29B. FIG. 31B is a sectional view through the section 31B-31B of FIG. 29B, illustrating another arrangement of sheet separator 826. More specifically, sheet separator 826 functions to separate single magnetizable sheets 810 from stack 811 during sheet advancement. Referring to FIG. 31A and FIG. 31B, sheet separator 826 comprises a double-feed stop assembly combining a stop roller 834 and feed guard 852, as shown. Stop roller 834 is located centrally above feed path 831 and forms a nip with panel 106 at a leading edge of the lower magnetizable sheets 810 of stack 811. Sheets at the bottom of stack 811 are urged by the outer peripheral surface of stop roller 834 toward the magnetic array 820. Magnetizable sheets 810 in the upper portion of stack 811 abut against the forward wall 854 of feed guard 852 (see also FIG. 35), which is located perpendicular to first sidewall 836 and second sidewall 838 of stack positioning tray 828 at an end adjacent to the magnetic array 820. Feed guard 852 is configured to limit forward movement of the upper portion of stack 811 in a direction having an orientation substantially parallel to feed path 831 (see also FIG. 33). The lower portion of feed guard 852 comprises a gap 853 forming a sheet passage to enable passage of at least one magnetizable sheet 810 at the bottom of stack 811 to stop roller 834 (see FIG. 35).

Assisted by sloping surface 842, the bottom magnetizable sheets 810 are urged or biased into the nip formed between stop roller 834 and panel 106. As magnetic array 820 rotates, it pulls the bottommost sheet through the nip. Subsequent sheets are advanced by friction between adjacent sheets, the rotation of stop roller 834 by the preceding sheet, and the magnetic attraction between the sheets and magnetic array 820. Magnetizable sheets 810 passing over magnetic array 820 are thereby permanently magnetized. The spacing between stop roller 834 and panel 106 may be adjustable so as to optimize passage of a single bottommost sheet through the nip. For example, the spacing between stop roller 834 may be manually adjustable via vertical adjuster 835. Vertical adjuster 835 includes a force-producing spring 837 adapted to maintain a constant downward force between stop roller 834 and magnetizable sheet 810. The use of spring 837 allows stop roller 834 to freely translate vertically with the spacing between stop roller 834 and panel 106 being self adjusting.

Alternately, stop roller 834 is free to translate vertically with the spacing self adjusted simply by the weight of the stop-roller assembly. Stop rollers suitable for use as stop roller 834 include oil-resistant neoprene idler rollers, 1 inch diameter×½ inch width, ¼" bore I.D. (Inside Diameter), model 60885K87 supplied by McMaster-Carr of Santa Fe Springs, Calif. Both stop roller 834 and feed guard 852 are adjustably supported over panel 106 by a ½-inch square bar 864 spanning in a transverse orientation above panel 106, as shown in FIGS. 29B, 30, 31B-34. The ends of square support bar 864 are rigidly secured by a pair of end mounts 866, which are firmly secured to a set of mounting blocks 868 located below panel 106. Mounting blocks 868 also function as end supports for the rotating magnetic array 820.

FIG. 32 is a front elevation view, illustrating multi-sheet feeder 802 of portable magnetizer system 100, according to the embodiment of FIG. 29A. FIG. 33 is a top view, illustrating multi-sheet feeder 802 of portable magnetizer system 100, according to the embodiment of FIG. 29A. Preferably, both first sidewall 836 and second sidewall 838 are moveably positionable such that a distance of separation A between the two sidewalls is adjustable. This preference allows magnetizable sheets 810 of various sizes to be processed by multi-sheet feeder 802. First sidewall 836 and second sidewall 838 are mounted to panel 106 via respective adjustable mounts 856. Adjustable mounts 856 are configured to translate (slide) along a set of transverse slots 858, each slot having a slot width, for example, of about 5/16 inch, which are formed within panel 106, as shown in FIGS. 29B, 30 and 33.

Figure 34:
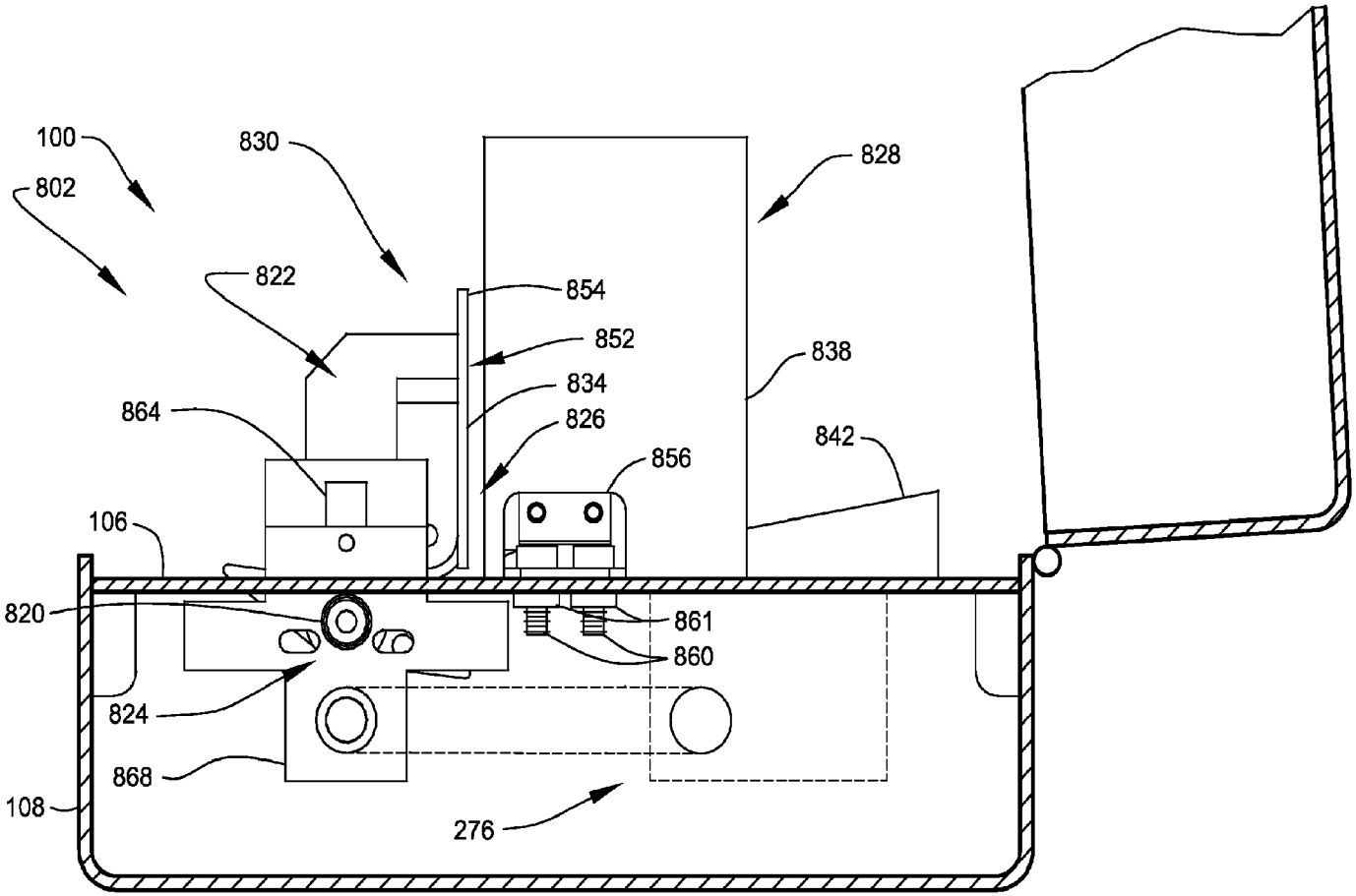
FIG. 34 is a sectional view, through the section 34-34 of FIG. 29A, illustrating the multi-sheet feeder mounted within a briefcase enclosure, according to the embodiment of FIG. 29A.

Each adjustable mount 856 is secured to panel 106 by threaded fasteners 860 extending through the mount to engage t-slot nuts 861 fitted within the transverse slots 858, as shown in FIGS. 33 and 34. This arrangement permits the adjustable mounts 856 to translate along the slots 858, when the threaded fasteners are sufficiently loosened, and to fix the adjustable mounts 856 at a selected position, relative to panel 106, when the threaded fasteners are sufficiently tightened. The linear paths of adjustable mounts 856 along transverse slots 858 are clearly visible. Threaded fasteners suitable for use as threaded fasteners 860 include small-diameter knurled-head thumb screws with shoulders, aluminum, ¼ inch-20 thread, ¾ inch length, ½ inch head diameter, model 94567A570 supplied by McMaster-Carr of Santa Fe Springs, Calif. T-slot nuts 861 suitable for use as T-slot nuts 861 include black-oxide steel full-thread T-slot nuts, ¼ inch-20 thread size (for 5/16 inch slot width), model 94750A588 supplied by McMaster-Carr of Santa Fe Springs, Calif.

In addition, adjustable mounts 856 may be hinged to permit first sidewall 836 and second sidewall 838 to collapse downwardly, as diagrammatically shown in FIG. 32 in dashed lines, thus allowing compact containment within briefcase enclosure 108 when stored. Thus the assembly is stowable in the hand-carryable briefcase enclosure 108. Adjustable mounts 856 may comprise friction hinges having a constant resistance through the full range of motion. Friction hinges suitable for use as adjustable mounts 856 include aluminum friction hinges model 2190A21 as supplied by McMaster-Carr of Santa Fe Springs, Calif.

Figure 35:
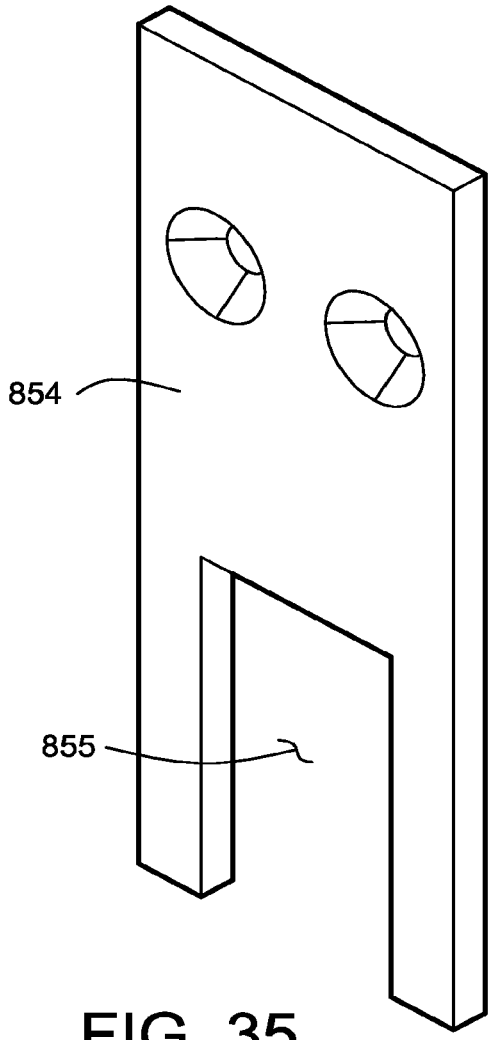
FIG. 35 is a perspective view of the forward wall of a feed guard according to the embodiment of FIG. 29A.

FIG. 34 is a sectional view through the section 34-34 of FIG. 29A, illustrating multi-sheet feeder 802, mounted within briefcase enclosure 108, according to the embodiment of FIG. 29A. Labelled in FIG. 34 is sheet-advancer 822, sheet separator 826, stack-positioning tray 828, stop roller 834, sloping surface 842, feed guard 852, adjustable mounts 856, threaded fasteners 860, t-slot nuts 861, square bar 864, and mounting blocks 868. FIG. 35 is a perspective view of forward wall 854 of feed guard 852. Wall 854 comprises a "U"-shaped member having a lower slot opening 855 configured to accommodate stop roller 834.

Thus, according to the above-described embodiment, there is provided a method relating to single-sheet feeding of magnetizable sheets 810 from stack 811 comprising the steps of: a) advancing individual magnetizable sheets 810 from stack 811 and b) permanently magnetizing the individual magnetizable sheets 810 as they are advanced from stack 811. It is again noted that the advancing step of (b) is assisted by ferromagnetic interaction between the individual magnetizable sheets 810 and magnetic field 154 of the rotating magnetic array 820.

The invention having been thus described, it will be apparent to those skilled in the art that the same may be varied in many ways without departing from the spirit and scope of the invention. Any and all such variations are intended to be encompassed by the following claims.

What is claimed is:

1. A sheet-feeder system for feeding of single magnetizable sheets from a stack of such sheets, to a sheet magnetizer for magnetizing said single magnetizable sheets, comprising:

a stack positioner configured to hold said stack;

a sheet advancer configured to advance single magnetizable sheets from the stack held in said stack positioner, said sheet advancer including a single-sheet separator configured to separate single magnetizable sheets from the stack when exiting the stack positioner; and a sheet magnetizer configured to permanently magnetize the separated single magnetizable sheets as they are advanced by said sheet advancer when exiting the stack positioner, said sheet magnetizer being configured to generate a magnetic field capable of inducing permanent magnetization of the magnetizable sheets during such sheet advancement, said sheet magnetizer being located adjacent to said stack positioner at an exit position of where the single magnetization sheets exit the stack positioner so that a magnetic attraction provided by a magnetic field of the sheet magnetizer is applied to the separated single magnetizable sheets to assist said sheet advancer to advance the separated single magnetizable sheets from the stack positioner to said sheet magnetizer.

2. The sheet-feeder system according to claim 1, further comprising a hand-carryable case in which said sheet-feeder system is mounted.

3. The sheet-feeder system according to claim 1, wherein said stack positioner comprises a lower support plate to support the stack, a first sidewall configured to limit lateral stack movement in a first direction, and a second sidewall, spaced apart from said first sidewall, configured to limit lateral stack movement in a second direction opposing the first direction.

4. The sheet-feeder system according to claim 3, wherein at least one of said first sidewall and said second sidewall is adjustably positionable such that a distance of separation between said first and second sidewalls is adjustable.

5. The sheet-feeder system according to claim 3, wherein said lower support plate comprises a sloped surface located between said first and second sidewalls, said sloped surface being configured to bias said stack of magnetizable sheets toward said sheet advancer.

6. The sheet-feeder system according to claim 1, wherein said sheet magnetizer comprises a permanent magnet.

7. The sheet-feeder system according to claim 6, wherein said permanent magnet is configured to comprise a roller that assists advancement of single magnetizable sheets from the stack by rotation, said system further comprising a rotator configured to rotate said roller.

8. The sheet-feeder system according to claim 7, wherein said roller comprises a plurality of discrete field-producing lamination sets spaced along a longitudinal axis of rotation, each discrete field-producing lamination set of said plurality comprising a circular magnetic disk and a circular flux-conducting spacer magnetically coupled with said circular magnetic disk.

9. The sheet-feeder system according to claim 7, wherein said roller is configured to magnetically couple to a magnetizable sheet when such magnetizable sheet is in position to pass through the magnetic field produced by said roller, to impart movement to the magnetizable sheet, such that the rotation of said roller moves magnetizable sheets through the magnetic field.

10. The sheet-feeder system according to claim 7, further comprising a sheet decoupler configured to decouple the magnetizable sheet from said at least one roller during movement of the magnetizable sheet through the magnetic field.

11. The sheet-feeder system according to claim 10, wherein said sheet decoupler comprises a plurality of decoupler elements.

12. The sheet-feeder system according to claim 11, wherein each of said plurality of decoupler elements are spaced every inch along a longitudinal axis of rotation of said roller.

13. The sheet-feeder system according to claim 1, wherein said single sheet separator comprises a separation roller located between said first and second sidewalls, a front wall configured to limit stack movement in a third direction substantially parallel to the moving direction of the magnetizable sheets advanced from the stack, and a sheet passage located adjacent to said separation roller and front wall, said sheet passage configured to enable passage of a magnetizable sheet separated from the stack therethrough.

14. The sheet-feeder system according to claim 3, wherein at least one of said first and second sidewalls is mounted to said lower support plate using a hinged mount to enable said at least one sidewall to collapse downwardly for stowage of said system.

15. A method for feeding single magnetizable sheets from a stack of such sheets to a sheet magnetizer for magnetizing the single magnetizable sheets, comprising:

loading the stack of the single magnetizable sheets into a stack positioner;

separating the stack of the single magnetizable sheets into separated single magnetizable sheets when exiting the stack positioner;

advancing the separated single magetizable sheets exiting from said stack positioner to a sheet magnetizer;

permanently magnetizing single magnetizable sheets by said sheet magnetizer, said sheet magnetizer being configured to generate a magnetic field capable of inducing permanent magnetization of the magnetizable sheets during such sheet advancement; and applying a magnetic attraction provided by a magnetic field of said sheet magnetizer to the separated single magnetizable sheets exiting the stack positioner to assist advancing the separated single magnetizable sheets from the stack to the sheet magnetizer.

16. A sheet-feeder system for feeding of single magnetizable sheets from a stack of such sheets, to a sheet magnetizer for magnetizing said single magnetizable sheets, comprising:

a stack positioner configured to hold the stack of single magetizable sheets;

a sheet advancer configured to advance single magnetizable sheets from the stack held in said stack positioner, said sheet advancer including a single-sheet separator configured to separate single magnetizable sheets from the stack during such sheet advancement; and a sheet magnetizer configured to permanently magnetize single magnetizable sheets as they are advanced by said sheet advancer, said sheet magnetizer being configured to generate a magnetic field capable of inducing permanent magnetization of the magnetizable sheets during such sheet advancement, said sheet magnetizer being located adjacent to said stack positioner at an exit position of the separated single magnetization sheets exiting the stack positioner so that a magnetic attraction provided by a magnetic field of the sheet magnetizer is applied to the separated single magnetizable sheets to assist the sheet advancer in advancing the separated single magnetizable sheets to the sheet magnetizer, wherein the sheet magnetizer is located adjacent to said stack positioner in a manner so that each separated single magnetizable sheet is still at least partially located within the stack positioner when the magnetic attraction provided by the magnetic field of the sheet magnetizer is applied to the particular separated single magnetizable sheet exiting the stack positioner, and wherein the separated single magnetizable sheets exiting the stack positioner encounter said sheet advancer prior to encountering said sheet magnetizer when advancing from the stack of single magnetizable sheets.

* * * * *